US005464724A

United States Patent [19]

Akiyama et al.

[11] Patent Number: 5,464,724

[45] Date of Patent: Nov. 7, 1995

[54] PS PLATE AND METHOD FOR PROCESSING SAME

[75] Inventors: Keiji Akiyama; Noriaki Watanabe; Hisashi Hotta; Tadao Toyama; Nobuyuki Nishimiya, all of Shizuoka, Japan

[73] Assignee: Fuji Photo Film Co., Ltd., Minami-Ashigara, Japan

[21] Appl. No.: 91,358

[22] Filed: Jul. 15, 1993

[30] Foreign Application Priority Data

Jul. 16, 1992 [JP] Japan ..... 4-189448

[51] Int. Cl.[6] ..... G03C 1/77

[52] U.S. Cl. ..... 430/272; 430/278; 430/302; 430/275; 101/456; 101/459

[58] Field of Search ..... 430/272, 278, 430/302, 275; 101/467, 463.1, 455, 459, 456

[56] References Cited

U.S. PATENT DOCUMENTS

| | | | |
|---|---|---|---|
| 4,232,105 | 11/1980 | Shinohara et al. | 430/160 |
| 4,264,707 | 4/1981 | Uozumi et al. | 430/278 |
| 4,445,998 | 5/1984 | Kanda et al. | 264/385 |
| 4,939,068 | 7/1990 | Lauke et al. | 430/278 |
| 4,983,497 | 1/1991 | Gilson et al. | 430/272 |
| 5,204,143 | 4/1993 | Nishimiya et al. | 430/275 |
| 5,345,869 | 9/1994 | Treverton et al. | 101/456 |

FOREIGN PATENT DOCUMENTS

| | | | |
|---|---|---|---|
| 0528395 | 2/1993 | European Pat. Off. | 430/950 |
| 2-40657 | 2/1990 | Japan | 430/302 |
| 1413374 | 11/1975 | United Kingdom . | |
| 1441476 | 6/1976 | United Kingdom | 430/302 |
| WO91/12140 | 8/1991 | WIPO . | |

OTHER PUBLICATIONS

Brinker, C. Jeffrey et al. *Sol–Gel Science* The Physics and Chemistry of Sol–Gel Processing, (1990) Academic Press, Inc; San Diego, Calif. pp. 1–5.

PTO English Translation of JP 2–40657 (Published Feb. 9, 1990).

*Primary Examiner*—Janis L. Dote

*Attorney, Agent, or Firm*—Burns, Doane, Swecker & Mathis

[57] ABSTRACT

A PS plate comprises an aluminum substrate having anodized layers on both sides, a photosensitive layer on one side of the substrate and a coating layer of a metal oxide obtained by hydrolyzing and polycondensing an organic or inorganic metal compound on the side of the substrate opposite to that carrying the photosensitive layer. The PS plate is processed by a method comprising the steps of imagewise exposing it to light and then developing the imagewise exposed plate with an alkali aqueous solution containing an alkali metal silicate and having a pH of not less than 12. The PS plate and the method for processing the same permit substantial reduction of the amount of a replenisher for development to be supplemented and ensure a stable processing of the plate over a long time period without accompanying formation of insolubles in a developer. The PS plates never cause adhesion and peeling off of the photosensitive layers even when they are put in stacks. Moreover, the PS plate does not suffer from a problem of contamination of the back face due to adhesion of lipophilic substances such as a developing ink.

17 Claims, No Drawings

PS PLATE AND METHOD FOR PROCESSING SAME

BACKGROUND OF THE INVENTION

The present invention relates to a presensitized plate for use in making a lithographic printing plate (hereinafter referred to as "PS plate") comprising an aluminum substrate and a developing process therefor and more specifically to a PS plate suitably processed by an automatic developing machine as well as a developing method thereof.

A positive-working PS plate which has been widely used comprises an aluminum plate as a substrate provided thereon with a light-sensitive layer comprising an o-quinonediazide compound. The o-quinonediazide compound is known to be converted into a carboxylic acid through exposure to ultraviolet rays. Accordingly, when a PS plate of this type which is exposed to ultraviolet rays is developed with an aqueous alkali solution, only the exposed portion of the light-sensitive layer comprising the compound is removed and the corresponding surface of the substrate is exposed. The surface of the substrate exposed through development (non-image area) receives water and repels an oil-based ink because of the hydrophilic properties of the exposed surface of the substrate, while the light-sensitive layer (image area) which is not removed through development repels water and accepts an oil-based ink because of the lipophilic properties of the light-sensitive layer. There have been known various aqueous alkaline solutions used as developers for the positive-working PS plates of this type, but most preferred are aqueous solutions of silicates such as sodium silicate and potassium silicate. This is because the developing ability of the developer may be controlled to some extent by adjusting the ratio of the silicon oxide $SiO_2$ to the alkali metal oxide $M_2O$ as the components of the silicate (in general expressed in terms of molar ratio: $[SiO_2]/[M_2O]$) and the concentrations thereof.

These silicates have been preferably used as components of developers not only for the aforementioned positive-working PS plates, but also for negative-working PS plates for reversal processing which comprise o-quinonediazide-containing light-sensitive layers as disclosed in Japanese Patent Publication for Opposition Purpose (hereinafter referred to as "J.P. KOKOKU") No. Sho 56-14970 and U.S. Pat. No. 4,576,901, negative-working PS plates which comprise alkali-soluble diazonium salts in the light-sensitive layers and negative-working PS plates which comprise light-sensitive layers containing, as photocrosslinkable agents, resins carrying dimethylmaleimido groups on the side chains as described in European Laid-Open Patent No. 0492959A.

Recently, there have been widely used automatic machines for developing PS plates in the fields of plate-making and printing to rationalize and standardize the plate-making operations. The automatic developing machine generally comprises a device for conveying a PS plate to be processed, a tank for accommodating a developer and a device for spraying the developer on the PS plate so that the PS plate is developed by spraying the pumped up developer on the PS plate through a spray nozzle while horizontally conveying the PS plate. Alternatively, there has recently been known a developing method comprising dipping a PS plate in a bath for development while conveying the PS plate by means of, for instance, dipped rolls for guiding the plate in the developer.

Japanese Un-examined Patent Publication (hereinafter referred to as "J.P. KOKAI") No. Sho 54-62004 (=U.S. Pat. No. 4,259,434) discloses that, when a positive-working PS plate is developed with such an automatic developing machine, a large quantity of positive-working PS plates can be processed over a long time without exchanging the developer accommodated in a tank through the use of an aqueous solution of sodium silicate having a molar ratio: $SiO_2/Na_2O$ ranging from 1.0 to 1.5 (i.e., $[SiO_2]/[Na_2O]$ of 1.0 to 1.5) and an $SiO_2$ content ranging from 1 to 4% by weight, as a developer, and by continuously or intermittently adding, to the developer, an aqueous solution (replenisher) of sodium silicate having a molar ratio: $SiO_2/Na_2O$ ranging from 0.5 to 1.5 (i.e., $[SiO_2]/[Na_2O]$ of 0.5 to 1.5).

If a substantially large quantity of PS plates are processed, however, this developing method suffers from a problem in that insoluble matter is formed in the developer. This in turn leads to the adhesion thereof to the resulting lithographic printing plates and the clogging of a spray nozzle and a filter. It has been known that the formation of insoluble matter becomes conspicuous in the development of the positive-working PS plate comprising an aluminum plate having an anodized layer as a substrate. U.S. Pat. No. 4,259,434 proposes a technique for eliminating the drawback in which the developer used comprises a solution of an alkali metal silicate having a molar ratio $[SiO_2]/[M]$ ranging from 0.5 to 0.75 (i.e., $[SiO_2]/[M_2O]$ of 1.0 to 1.5) and an $SiO_2$ content of 1 to 4% by weight; the replenisher used comprises a solution of an alkali metal silicate having a molar ratio $[SiO_2]/[M]$ ranging from 0.25 to 0.75 (i.e., $[SiO_2]/[M_2O]$ of 0.5 to 1.5) and both developer and replenisher contain at least 20% of potassium on the basis of the total gram atoms of the alkali metals present therein. This method allows the elimination of the problem concerning the formation of insoluble matter in the developer, but suffers from other problems in that the activity of the replenisher is rather insufficient and that the method requires the use of a large amount of the replenisher. These drawbacks can be eliminated by the method disclosed in European Laid-Open Patent No. 0347245A in which the development is performed in an automatic developing machine comprising a dip-developing zone provided with a floating cover for preventing any contact between the air and the surface of the developer, but it has still been requested to further reduce the running cost and the amount of the waste liquor. In particular, the reduction in the industrial waste has been attracted special interest recently on a worldwide scale.

European Laid-Open Patent No. 0490515A elucidates that the anodized layer on the face (hereinafter referred to as "back face of substrate") of an aluminum substrate opposite to that carrying a light-sensitive layer is dissolved in a developer to a large extent during developing a PS plate and that this becomes a cause of the formation of insoluble matter in the developer. This patent further discloses an effective means for solving this problem, which comprises applying a coating layer (protective layer) consisting of an organic polymeric compound onto the back face of the aluminum substrate.

However, some of these protective layers used get swollen during printing operations depending on the kinds of agents used, this in turn results in a change of the printing pressure and accordingly deteriorates the printing durability of the resulting lithographic printing plate. Moreover, it has also been found that the application of a hydrophobic organic polymer layer onto the back face suffers from a problem of background contamination of copies due to adhesion of a lipophilic substance such as an ink to the back face during using the printing plate.

On the other hand, J.P. KOKAI No. Hei 3-90388 discloses a method for inhibiting the deposit of white powder on the back face of a PS plate due to the action of a developer, which comprises treating the back face of the PS plate with an alkali metal silicate. However, this method suffers from various problems. For instance, the method is complicated in that it requires the use of a processing solution maintained at a high temperature ranging from 50° to 90° C. and an additional treatment with an alkali after the processing. Moreover, the processing solution is a strong alkaline aqueous solution and accordingly, is insufficient in an uniformly spreading ability and would reduce the adhesion between the light-sensitive layer and the aluminum substrate if the processing solution accidentally passes around behind the light-sensitive layer side. In addition, the back face treated according to this method is hydrophilic. Therefore, if a plurality of the sheet-like PS plates of this type are put in a stack, this leads to the adhesion of a hydrophilic mat layer formed on the light-sensitive layer to the back face and in turn results in the adhesion between neighbouring two PS plates and peeling off of some light-sensitive films.

SUMMARY OF THE INVENTION

Accordingly, an object of the present invention is to provide an improved PS plate and a method for processing the foregoing PS plate, which permit the reduction of the amount of a replenisher for developer during development of the PS plate and correspondingly the amount of industrial waste.

Another object of the present invention is to provide an improved PS plate and a method for processing the PS plate which permits the stable processing of a large quantity thereof over a long time period without forming any insoluble matter.

A further object of the present invention is to provide an improved PS plate which can provide a lithographic printing plate free of background contamination due to adhesion of any lipophilic substance such as an ink on the back face of the substrate, a large quantity of which can be processed with an automatic developing machine over a long time without causing the formation of insolubles in a developer and which can accordingly be processed stably over a long time period without exchanging the developer as well as a method for processing the same.

The inventors of this invention have conducted various studies to accomplish the foregoing objects, as a result have found out that it is effective to use a coating layer of a metal oxide prepared by the sol-gel method as a back coat which is hydrophobic and excellent in resistance to developer prior to development and which acquires hydrophilicity through development and thus have completed the present invention.

According to an aspect of the present invention, there is provided a PS plate which comprises an aluminum substrate having anodized layers on both sides, a light-sensitive layer applied onto one side of the substrate and a coating layer of a metal oxide obtained by hydrolyzing and polycondensing an organic metal compound or an inorganic metal compound on the other side opposite to the side on which the light-sensitive layer is applied.

According to a second aspect of the present invention, there is provided a method for processing a PS plate which comprises the steps of imagewise exposing a PS plate comprising an aluminum substrate having anodized layers on both sides, a light-sensitive layer applied onto one side of the substrate and a coating layer of a metal oxide obtained by hydrolyzing and polycondensing an organic metal compound or an inorganic metal compound on the other side opposite to the side on which the light-sensitive layer is applied; and then developing the exposed PS plate with an aqueous alkaline solution containing an alkali metal silicate and having a pH of not less than 12.

According to a third aspect of the present invention, there is provided a method for processing a PS plate which comprises the steps of imagewise exposing a PS plate comprising an aluminum substrate having anodized layers on both sides, a light-sensitive layer applied onto one side of the substrate and a coating layer of a metal oxide obtained by hydrolyzing and polycondensing an organic metal compound or an inorganic metal compound on the other side opposite to the side on which the light-sensitive layer is applied; and then developing the exposed PS plate with an aqueous alkaline solution containing an alkali metal silicate, while compensating for a change of the developer during the developing process by addition of an aqueous solution of an alkali metal silicate as a replenisher to the developer, wherein the replenisher is an aqueous solution of an alkali metal silicate having a molar ratio: $[SiO_2]/[M_2O]$ (wherein $[SiO_2]$ represents the molar concentration (mole/l) of $SiO_2$ and $[M_2O]$ means the molar concentration of the oxide $M_2O$ of an alkali metal M) ranging from 0.3 to 1.0 and an $SiO_2$ content ranging from 0.5 to 4.0% by weight.

DESCRIPTION OF THE PREFERRED EMBODIMENTS

The PS plate and the method for processing the same according to the present invention will hereunder be described in more detail.

Substrate

The substrates used in the PS plate of the invention are plate-like materials of aluminum and aluminum alloys and paper or plastic films, both sides of which are laminated with plate-like materials of aluminum and aluminum alloys. Preferred are, for instance, pure aluminum plate and alloy plates comprising aluminum as a main component and a trace amount of other elements as well as plastic films laminated with an aluminum film or on which aluminum is vapor-deposited. An aluminum alloy comprises, in addition to aluminum, silicon, iron, manganese, copper, magnesium, chromium, zinc, bismuth, nickel and/or titanium. The amount of the elements other than aluminum is at most 10% by weight. The aluminum substrate preferably used in the invention is a pure aluminum plate, but it is presently difficult to obtain a completely pure aluminum plate from the viewpoint of refining technique. Therefore, the aluminum plate used herein may comprise a trace amount of other elements. Thus, the aluminum plates usable in the invention are not restricted to those having specific compositions and may be appropriately selected from those commonly known and used in this art such as JIS A1050, JIS A1100, JIS A3003, JIS A3103 and JIS A3005. The aluminum plate used in the invention has a thickness in the order of about 0.1 to 0.6 mm.

These aluminum plates are optionally treated with an organic solvent or an aqueous solution containing a surfactant or an alkali to remove the rolling oil from the surface thereof, prior to surface-roughening.

First, an aluminum plate as a substrate for the PS plate is surface-roughened by, for instance, a mechanical surface-roughening treatment, a surface-roughening method comprising electrochemical dissolution of the surface or a method for selectively dissolving the surface with a chemical. The mechanical surface-roughening treatments may be carried out by any known method such as ball graining, brush graining, blast graining and buff graining methods. In addition, the electrochemical surface-roughening treatment may be performed by, for instance, passing an alternating or direct current through the aluminum plate in an electrolyte such as a hydrochloric acid or nitric acid solution. Moreover, it is also possible to use combinations of these two kinds of methods as disclosed in U.S. Pat. No. 4,476,006.

The aluminum plate thus surface-roughened may optionally be subjected to alkali etching and neutralization treatments as described in U.S. Pat. No. 4,824,757 and thereafter, anodized for improving the water retention and wear resistance of the surface. Any electrolyte can be used in the anodization treatment of an aluminum plate as long as they can form a porous anodized layer and generally include, for instance, sulfuric acid, phosphoric acid, oxalic acid, chromic acid or mixture thereof. The concentration of these electrolytes are appropriately determined depending on the kinds of the electrolytes selected.

The conditions for the anodization vary depending on the kinds of the electrolytes selected, but in general the anodization is preferably performed at an electrolyte concentration ranging from 1 to 80% by weight, an electrolyte temperature ranging from 5° to 70° C., a current density ranging from 5 to 60 A/dm$^2$ and a voltage ranging from 1 to 100 V for 10 seconds to 5 minutes. Among these, preferred are a method for anodization at a high current density using a sulfuric acid solution as an electrolyte as disclosed in U.K. Patent No. 1,412,768 and a method for anodization in an aqueous solution of sulfuric acid having a low concentration as disclosed in U.S. Pat. No. 4,211,619 and the anodization is most preferably performed by a method which comprises passing a direct current through an aluminum plate at a current density ranging from 5 to 20 A/dm$^2$ in an electrolyte having a sulfuric acid concentration ranging from 5 to 20% by weight, at a dissolved aluminum ion concentration ranging from 3 to 15% by weight and at a temperature ranging from 25° to 50° C.

The amount of the anodized layer is preferably not less than 1.0 g/m$^2$ and more preferably 2.0 to 6.0 g/m$^2$. This is because if it is less than 1.0 g/m$^2$, the resulting lithographic printing plate has insufficient printing durability and the non-image portion thereof is easily damaged, which leads to the occurrence of so-called "contamination due to defects", i.e., the adhesion of ink to defects during the printing operation.

Incidentally, such an anodization layer is formed on the side of the substrate of the lithographic printing plate which is used in printing, but in general an anodized layer having a thickness of 0.01 to 3 g/m$^2$ is simultaneously formed on the back face since the lines of electric force pass around behind the substrate during anodization.

After the foregoing anodization, the aluminum plate is hydrophilized, if desired. In the present invention, the hydrophilization can be carried out by a treatment with an alkali metal silicate solution (such as an aqueous sodium silicate solution) as disclosed in U.S. Pat. Nos. 2,714,066, 3,181,461, 3,280,734 and 3,902,734. In this method, a substrate is treated by immersing or electrolyzing in an aqueous solution of sodium silicate. Examples of other hydrophilization treatments include a treatment with potassium fluorozirconate as disclosed in U.S. Pat. No. 2,946,683 and a treatment with polyvinyl phosphonic acid as disclosed in U.S. Pat. Nos. 3,276,868, 4,153,461 and 4,689,272.

Organic Underlying Layer

An organic underlying layer is also applied, if desired, onto the aluminum plate prior to the application of a light-sensitive layer. Organic compounds used in the organic underlying layer are, for instance, carboxymethyl cellulose, dextrin, gum arabic, amino group-containing phosphinic acids such as 2-aminoethylphosphonic acid, substituted or unsubstituted organic phosphonic acids such as phenylphosphonic acid, naphthylphosphonic acid, alkylphosphonic acids, glycerophosphonic acid, methylenediphosphonic acid and ethylenediphosphonic acid, esters of substituted or unsubstituted organic phosphoric acid such as esters of phenylphosphoric acid, naphthylphosphoric acid, alkylphosphoric acids and glycerophosphoric acid, substituted or unsubstituted organic phosphinic acids such as phenylphosphinic acid, naphthylphosphinic acid, alkylphosphinic acids and glycerophosphinic acid, amino acids such as glycine and β-alanine, and hydroxyl group-containing amine hydrochlorides such as triethanolamine hydrochloride. These organic compounds may be used alone or in combination.

In the present invention, the organic layer can be formed by a method comprising the steps of applying a solution of the foregoing organic compound dissolved in water, an organic solvent such as methanol, ethanol, methyl ethyl ketone or a mixture thereof to the hydrophilized aluminum plate and then drying or a method comprising the steps of dipping the hydrophilized aluminum plate in a solution of the foregoing compound dissolved in water, an organic solvent such as methanol, ethanol, methyl ethyl ketone or a mixture thereof to adsorb the compound on the plate, then washing with, for instance, water and drying. In the former, a coating solution containing the compound in a concentration ranging from 0.005 to 10% by weight can be applied by a variety of methods such as coating with a bar coater, whirler and spray or curtain coating, while in the latter method, the concentration of the solution ranges from 0.01 to 20% by weight, preferably 0.05 to 5% by weight and the dipping temperature ranges from 20° to 90° C., preferably 25° to 50° C. and the dipping time ranges from 0.1 second to 20 minutes, preferably 2 seconds to one minute.

The pH value of the solutions herein used may be adjusted to 1 to 12 with basic substances such as ammonia, triethylamine and potassium hydroxide or acidic substances such as hydrochloric acid or phosphoric acid. Moreover, a yellow dye can be added for the improvement of tone reproduction of the PS plates.

The coated amount (weighed after drying) of the organic underlying layer suitably ranges from 2 to 200 mg/m$^2$, preferably 5 to 100 mg/m$^2$. This is because, if the coated amount is less than 2 mg/m$^2$, the printing durability of the resulting lithographic printing plate is insufficient, while if it exceeds 200 mg/m$^2$, sufficient printing durability cannot likewise be obtained.

Back Coat Layer

A coating layer of an organometal compound obtained by hydrolyzing and polycondensing an organic metal compound or inorganic metal compound (hereinafter referred to as "back coat layer") is applied onto the back face of the substrate of the PS plate to prevent the liquation of the anodized layer on the aluminum substrate. The metal oxide used in the back coat layer are, for instance, silica (silicon oxide), titanium oxide, boron oxide, aluminum oxide and zirconium oxide as well as compound oxides thereof.

The coating layer of a metal oxide used in the invention can be prepared by coating the back face of a substrate with a so-called sol-gel reaction solution obtained through hydrolysis and polycondensation of an organic or inorganic metal compound in water and an organic solvent in the presence of an acid or alkali catalyst and then drying.

The organic or inorganic metal compounds herein used are, for instance, metal alkoxides, metal acetylacetonates, metal acetates, metal oxalates, metal nitrates, metal sulfates, metal carbonates, metal oxychlorides, metal chlorides and condensates obtained by partially hydrolyzing the foregoing metal compounds into the corresponding oligomers.

The alkoxides can be represented by the general formula: $M(OR)_n$ (wherein M represents a metal element, R represents an alkyl group and n is the oxidation number of the metal M). Specific examples thereof usable herein are $Si(OCH_3)_4$, $Si(OC_2H_5)_4$, $Si(OC_3H_7)_4$ , $Si(OC_4H_9)_4$, $Al(OCH_3)_3$, $Al(OC_2H_5)_3$, $Al(OC_3H_7)_3$, $Al(OC_4H_9)_3$, $B(OCH_3)_3$, $B(OC_2H_5)_3$, $B(OC_3H_7)_3$, $B(OC_4H_9)_3$, $Ti(OCH_3)_4$, $Ti(OC_2H_5)_4$, $Ti(OC_3H_7)_4$, $Ti(OC_4H_9)_4$, $Zr(OCH_3)_4$, $Zr(OC_2H_5)_4$, $Zr(OC_3H_7)_4$ and $Zr(OC_4H_9)_4$. In addition to these alkoxides, alkoxides of other metals such as Ge, Li, Na, Fe, Ga, Mg, P, Sb, Sn, Ta and V can likewise be used in the invention. Further examples of alkoxides used in the invention include monosubstituted silicon alkoxides such as $CH_3Si(OCH_3)_3$, $C_2H_5Si(OCH_3)_3$, $CH_3Si(OC_2H_5)_3$ and $C_2H_5Si(OC_2H_5)_3$.

Examples of metal acetylacetonates usable in the invention are $Al(COCH_2COCH_3)_3$ and $Ti(COCH_2COCH_3)_4$; examples of metal oxalates are $K_2TiO(C_2O_4)_2$; examples of metal nitrates are $Al(NO_3)_3$ and $ZrO(NO_3)_2.2H_2O$; examples of metal sulfates include $Al_2(SO_4)_3$, $(NH_4)Al(SO_4)_2$, $KAl(SO_4)_2$ and $NaAl(SO_4)_2$; examples of metal oxychlorides are $Si_2OCl_6$ and $ZrOCl_2$; and examples of metal chlorides are $AlCl_3$, $SiCl_4$, $ZrCl_2$ and $TiCl_4$.

These organic or inorganic metal compounds may be used alone or in combination.

Among these organic and inorganic metal compounds, metal alkoxides are preferred because they have high reactivity and are likely to give polymers including metal-oxygen bonds. Particularly preferred are silicon alkoxide compounds such as $Si(OCH_3)_4$, $Si(OC_2H_5)_4$, $Si(OC_3H_7)_4$ and $Si(OC_4H_9)_4$ since they are cheap and easily available, and can provide metal oxide coating layers exhibiting excellent resistance to developer. In addition, it is also preferred to use oligomers obtained by partially hydrolyzing and condensing these alkoxide compounds of silicon. An example thereof is an ethylsilicate oligomer comprising 5 monomers on the average and having an $SiO_2$ content of about 40% by weight.

Moreover, preferred examples also include combinations of the foregoing silicon alkoxide compounds or oligomers with so-called silane-coupling agents obtained by replacing one or two alkoxy groups of the foregoing tetraalkoxy compounds of silicon with alkyl groups or reactive other groups. Specific examples of such silane-coupling agents are vinyltrimethoxysilane, vinyltriethoxysilane, γ-(methacryloxypropyl)trimethoxysilane, β-(3,4-epoxycyclohexyl)ethyltrimethoxysilane, γ-glycidoxypropyltrimethoxysilane, γ-glycidoxypropylmethyldiethoxysilane, N-β(aminoethyl)-γ-aminopropyltrimethoxysilane, N-β (aminoethyl)-γ-aminopropylmethyldimethoxysilane, γ-aminopropyltriethoxysilane, N-phenyl-γ-aminopropyltrimethoxysilane, γ-mercaptopropyltrimethoxysilane, γ-chloropropyltrimethoxysilane, methyltrimethoxysilane and methyltriethoxysilane.

On the other hand, organic and inorganic acids and alkalis are used as the catalysts. Examples thereof are inorganic acids such as hydrochloric acid, sulfuric acid, sulfurous acid, nitric acid, nitrous acid, hydrofluoric acid, phosphoric acid and phosphorous acid; organic acids such as formic acid, acetic acid, propionic acid, butyric acid, glycolic acid, chloroacetic acid, dichloroacetic acid, trichloroacetic acid, fluoroacetic acid, bromoacetic acid, methoxyacetic acid, oxaloacetic acid, citric acid, oxalic acid, succinic acid, malic acid, tartaric acid, fumaric acid, maleic acid, malonic acid, ascorbic acid, benzoic acid, substituted benzoic acids, e.g., 3,4-dimethoxybenzoic acid, phenoxyacetic acid, phthalic acid, picric acid, nicotinic acid, picolinic acid, pyrazine, pyrazole, dipicolinic acid, adipic acid, p-toluylic acid, terephthalic acid, 1,4-cyclohexene-2,2-dicarboxylic acid, erucic acid, lauric acid and n-undecanoic acid; and alkalis such as hydroxides of alkali metals and alkaline earth metals, ammonia, ethanolamine, diethanolamine and triethanolamine.

In addition to the foregoing acids and alkalis, it is also possible to use organic acids such as sulfonic acids, sulfinic acids, alkylsulfuric acids, phosphonic acids and phosphoric acid esters, for instance, p-toluenesulfonic acid, dodecylbenzenesulfonic acid, p-toluenesulfinic acid, ethylic acid, phenylphosphonic acid, phenylphosphinic acid, phenyl phosphate and diphenylphosphate.

These catalysts may be used alone or in combination. The amount of these catalysts preferably ranges from 0.001 to 10% by weight and more preferably 0.05 to 5% by weight on the basis of the weight of the starting metal compound. This is because if the amount of the catalyst is less than the lower limit, the desired sol-gel reaction proceeds at a low rate, while if it exceeds the upper limit, the reaction proceeds rapidly. This results in the formation of non-uniform sol-gel particles and in turn the formation of a coating layer exhibiting low resistance to the developer.

Further an appropriate amount of water is required for the initiation of the sol-gel reaction and the amount thereof preferably ranges from 0.05 to 50 times and more preferably 0.5 to 30 times the molar amount of water required for completely hydrolyzing the starting metal compound. If the amount of water is less than the lower limit, the hydrolysis hardly proceeds, while if it exceeds the upper limit, the starting material is excessively diluted and the reaction rate is substantially lowered.

A solvent is further added to the sol-gel reaction solution. The solvent usable must dissolve the starting metal compound and dissolve or disperse the resulting sol-gel particles therein. Examples thereof include lower alcohols such as methanol, ethanol, propanol and butanol; and ketones such as acetone, methyl ethyl ketone and diethyl ketone. Moreover, it is also possible to use mono- or dialkyl ethers and acetates of glycols such as ethylene glycol, diethylene glycol, triethylene glycol, propylene glycol and dipropylene glycol for improving, for instance, the surface properties of the applied back coat layer. Among these, preferred are lower alcohols miscible with water. A solvent is added to the sol-gel reaction solution to adjust the concentration thereof and to thus make the solution suitable for application. If all of the solvent required is initially added to the reaction solution, however, the hydrolysis hardly proceeds possibly due to excessive dilution of the starting material. For this reason, the solvent is added in such a manner that a part thereof is first added to the sol-gel reaction solution and the remaining solvent is added thereto at an instance when the reaction proceeds to some extent.

The sol-gel reaction starts upon mixing a starting metal oxide, water, a solvent and a catalyst. The reaction rate varies depending on the kinds and mixing ratio of these compounds used as well as the reaction temperature and time selected and affects the properties of the resulting film. The rate is greatly influenced by the reaction temperature and accordingly, the temperature is preferably controlled during the reaction.

In addition to the foregoing essential components, a hydroxyl group-, amino group- or active hydrogen atom-containing compound may be added to the sol-gel reaction solution in order to appropriately control the sol-gel reaction. Examples of such compounds are polyethylene glycol, polypropylene glycol, block copolymers thereof and monoalkyl ethers or monoalkylaryl ethers thereof; various kinds of phenols such as phenol and cresols; polyvinyl alcohols and copolymers of vinyl alcohol with other vinyl monomers; hydroxyl group-containing acids such as malic acid and tartaric acid; aliphatic and aromatic amines; formamide and dimethylformamide.

Moreover, the sol-gel reaction solution may optionally comprise an organic and inorganic polymer for improving the film-forming properties of the back coat layer and a plasticizer, a surfactant and/or other additives for imparting flexibility to the resulting back coat layer and for controlling the slip properties thereof.

Examples of preferred polymers are polyvinyl alcohol, polyvinyl acetate, silicone resin, polyamide, polyurethane, polyurea, polyimide, polysiloxane, polycarbonate, epoxy resin, phenol novolak resin, condensed resins of phenols with aldehydes or ketones, acetal resin, polyvinyl chloride, polyvinylidene chloride, polystyrene, acrylic resins and copolymer resins thereof. More specifically, preferably used include novolak resins such as phenol-, cresol-, t-butylphenol- and octylphenol- novolak resins, condensed resin of pyrogallol with acetone, and homopolymers or copolymers of p-hydroxystyrene and hydroxyethyl methacrylate.

Other preferred polymers include, for instance, copolymers comprising the following monomers (1) to (12) as structural units and having a molecular weight usually ranging from 10,000 to 200,000.

(1) aromatic hydroxyl group-containing acrylamides, methacrylamides, acrylates, methacrylates and hydroxystyrenes such as N-(4-hydroxyphenyl)(meth)acrylamide, o-, m- and p-hydroxystyrene, and o-, m- and p-hydroxyphenyl (meth-)acrylate;

(2) aliphatic hydroxyl group-containing (meth)acrylates such as 2-hydroxyethyl (meth)acrylate;

(3) (Substituted) alkyl acrylates such as methyl acrylate, ethyl acrylate, propyl acrylate, butyl acrylate, amyl acrylate, hexyl acrylate, cyclohexyl acrylate, octyl acrylate, phenyl acrylate, benzyl acrylate, 2-chloroethyl acrylate, 4-hydroxybutyl acrylate, glycidyl acrylate and n-dimethylaminoethyl acrylate;

(4) (Substituted) alkyl methacrylates such as methyl methacrylate, ethyl methacrylate, propyl methacrylate, butyl methacrylate, amyl methacrylate, hexyl methacrylate, cyclohexyl methacrylate, octyl methacrylate, phenyl methacrylate, benzyl methacrylate, 2-chloroethyl methacrylate, 4-hydroxybutyl methacrylate, glycidyl methacrylate and N-dimethylaminoethyl methacrylate;

(5) (Meth)acrylamides such as (meth)acrylamide, N-methylol (meth)acrylamide, N-ethyl (meth)acrylamide, N-hexyl (meth) methacrylamide, N-cyclohexyl (meth)acrylamide, N-hydroxyethyl (meth)acrylamide, N-phenyl (meth)acrylamide, N-benzyl (meth) acrylate, N-nitrophenyl (meth)acrylamide and N-ethyl-N-phenyl (meth)acrylamide;

(6) Vinyl ethers such as ethyl vinyl ether, 2-chloroethyl vinyl ether, hydroxyethyl vinyl ether, propyl vinyl ether, butyl vinyl ether, octyl vinyl ether and phenyl vinyl ether;

(7) Vinyl esters such as vinyl acetate, vinyl chloroacetate, vinyl butyrate and vinyl benzoate;

(8) Styrenes such as styrene, methylstyrene and chloromethylstyrene;

(9) Vinyl ketones such as methyl vinyl ketone, ethyl vinyl ketone, propyl vinyl ketone and phenyl vinyl ketone;

(10) Olefins such as ethylene, propylene, isobutylene, butadiene and isoprene;

(11) N-vinyl pyrrolidone, N-vinyl carbazole, 4-vinyl pyridine, acrylonitrile and methacrylonitrile;

(12) Unsaturated sulfonamides such as (meth)acrylamides, e.g., N-(o-aminosulfonylphenyl) (meth)acrylamide, N-(m-aminosulfonylphenyl) (meth)acrylamide, N-(p-aminosulfonylphenyl) (meth)acrylamide, N-(1-(3-aminosulfonyl) naphthyl) (meth)acrylamide and N-(2-aminosulfonylethyl) (meth) acrylamide; and (meth)acrylic acid esters, e.g., o-aminosulfonylphenyl (meth)acrylate, m-aminosulfonylphenyl (meth)acrylate, p-aminosulfonylphenyl (meth-)acrylate and 1-(3-aminosulfonylnaphthyl) (meth)acrylate.

Further, the foregoing monomers may optionally be copolymerized with other monomers copolymerizable therewith and the copolymers of the monomers listed above can be modified with, for instance, glycidyl (meth)acrylate. However, the copolymers usable in the invention are not limited to these specific examples.

The polymers are optionally added to the back coat layer-forming solution in the form of a latex. Examples of preferred latexes are emulsions of copolymers of polyacrylic acid esters such as JULIMER ET-410, SEK-301, SEK-101, FC-30, FC-60, FC-80, SE-5101, SE-5102, SE-5103, SE-5301, SE-361, SE-363, SE-365, SE- 6302, SE-6311 and SE-6312 (the trade names; available from Nippon Pure Chemicals, Co., Ltd.), Nipol LX811, LX814, LX841, LX851, LX852, LX-854, LX856, LX860 and LX874 (the trade names; available from Nippon Zeon Co., Ltd.), and PRIMAL AC-22, AC-33, AC-3444, AC-55, AC-61, AC-382, ASE-60, ASE-75, ASE-108, B-15, B-41, B-74, B-336, B-505, B-832, B-924, C-72, E-32, E-358, HA- 8, HA-16, HA-24, I-94, LC-40, LT-76, LT-87, MC-4530, N-580, P- 6N, P-1060, S-1, TR-49 and 850 (the trade names; available from Nippon Acryl Chemical Co., Ltd.); acrylonitrile/butadiene type latexes such as Nipol 1551, 1561, 1562, 1571, 1577, LX511, LX513, LX531 and LX531B (the trade names; available from Nippon Zeon Co., Ltd.); styrene/butadiene type latexes such as Nipol LX111, 4850, 4850A, LX110, LX119, LX204, LX206, LX209, 2507, LX303, 2518FS, LX415A, LX426, LX430, LX432A, LX433, LX472, 2570X5, LX407BP, LX407C, LX407F and LX407G (the trade names; available from Nippon Zeon Co., Ltd.); vinyl chloride type latexes such as Geon 150X15, 351 and 576 (the trade names; available from Nippon Zeon Co., Ltd.); urethane resin emulsions such as VONDIC 1041NS, 1050B-NS, 1230NS, 1250, 1310NSC, 1320NSC, 1510, 1610NS, 1512NSC, 1640, 1660NS, 1670NS, 1930A-NS, 1980NS, 1205, 2220 and 2230 (the trade names; available from Dainippon Ink and Chemicals, Inc.), ARON NEOTHANE UE-1101, UE-1200, UE- 1300, UE-1402, UE-2103, UE-2200, UE-2600, UE-2900, UE-5404 and UE-5600 (the trade names; available from Toagosei Chemical Industry Co., Ltd.); colloidal dispersion type urethane resins such as HYDRAN HW-301, HW-310, HW-311, HW-312B, HW-333, HW-340, HW-350, HW-111, HW-140, HW-910, HW-920, HW-930, HW-940, HW-950 and HW-960 (the trade names; available from Dainippon Ink and Chemicals, Inc.).

Preferably used also include water-soluble resins such as hydroxypropyl cellulose, hydroxyethyl cellulose, methyl cellulose, carboxymethyl cellulose, polyvinyl pyrrolidone and polyvinyl methyl ether.

These polymers are added in such an amount that the resulting back coat layer holds its appropriate hydrophilicity after development of the corresponding PS plate. More specifically, the amount thereof is preferably 1 to 200%, more preferably 2 to 200%, and most preferably 5 to 50%, by weight on the basis of the starting metal compound.

The back coat layer may further comprise a plasticizer in addition to the foregoing polymer for preventing any adhesion of dust to the layer and/or other troubles due to peeling off of the solidified coating solution during production and coating operations and for imparting flexibility to the resulting layer. Examples of plasticizers effectively used in the back coat layer include dimethyl phthalate, diethyl phthalate, dibutyl phthalate, diheptyl phthalate, dioctyl phthalate, butylbenzyl phthalate, diisodecyl phthalate, ethyl phthalylethyl glycolate, methyl phthalylethyl glycolate, butyl phthalylbutyl glycolate, diisobutyl phthalate, octyl capryl phthalate, dicyclohexyl phthalate, ditridecyl phthalate, diallyl phthalate, dimethyl glycol phthalate, triethylene glycol dicaprylate, trioctyl trimellitate, dioctyl adipate, dioctyl azelate, dibutyl sebacate, dioctyl sebacate, methylacetyl ricinoleate, dimethyl maleate, diethyl maleate, dibutyl maleate, dioctyl maleate, dibutyl fumarate, dioctyl fumarate, adipic acid-propylene glycol ester, adipic acid-1,3-butylene glycol ester, glycerol triacetate, glycerol tributyrate, cellulose acetate phthalate, trimethyl phosphate, triethyl phosphate, tributyl phosphate, trioctyl phosphate, tributoxyethyl phosphate, trischloroethyl phosphate, trisdichloropropyl phosphate, mono-2,3-dichloropropyl-bis-2,3-dibromopropyl phosphate, triphenyl phosphate, tricresyl phosphate, trixylenyl phosphate, cresyl diphenyl phosphate, diphenyl mono-o-xylenyl phosphate, octyl diphenyl phosphate, triphenyl phosphite, trilauryl trithiophosphite, trischloroethyl phosphite, trilauryl phosphite, trisnonylphenyl phosphite, trisdinonylphenyl phosphite, dibutyl hydrogen phosphite, isopropyl acid phosphate, butyl acid phosphate, dibutyl phosphate, octyl acid phosphate, dioctyl phosphate, isodecyl acid phosphate, monoisodecyl phosphate and tridecanol acid phosphate. Among these, those having boiling points at 760 mmHg of not less than 250° C. are particularly effective. Moreover, preferred are those having hydrophilicity as high as possible for preventing the deterioration of resistance to contamination due to adhesion of lipophilic substances during the plate-making process. The plasticizer is added to the back coat layer in such an amount that the layer is not sticky. The amount generally ranges from 1 to 100% by weight, preferably 3 to 60% by weight and more preferably 5 to 30% by weight on the basis of the weight of the starting metal compound. This is because the back face is easily contaminated with lipophilic substances such as inks through adhesion, as the added amount thereof increases.

Preferred examples of surfactants usable in the back coat layer include non-ionic surfactants such as polyoxyethylene alkyl ethers, polyoxyethylene alkylphenyl ethers, polyoxyethylene polystyrylphenyl ethers, polyoxyethylene polyoxypropylene alkyl ethers, partially esterified glycerol fatty acids, partially esterified sorbitan fatty acids, partially esterified pentaerythritol fatty acids, propylene glycol monofatty acid esters, partially esterified sucrose fatty acids, partially esterified polyoxyethylene sorbitan fatty acids, partially esterified polyoxyethylene sorbitol fatty acids, polyethylene glycol fatty acid esters, partially esterified polyglycerin fatty acids, polyoxyethylene-modified castor oils, partially esterified polyoxyethylene glycerin fatty acids, fatty acid diethanolamides, N,N-bis-2-hydroxyalkylamines, polyoxyethylene alkylamines, triethanolamine fatty acid esters and trialkylamine oxides; anionic surfactants such as fatty acid salts, abietic acid salts, hydroxyalkanesulfonic acid salts, alkanesulfonic acid salts, dialkylsulfosuccinic acid ester salts, linear alkylbenzenesulfonic acid salts, blanched alkylbenzenesulfonic acid salts, alkylnaphthalenesulfonic acid salts, alkylphenoxy polyoxyethylenepropylsulfonic acid salts, polyoxyethylene alkylsulfophenyl ether salts, sodium salt of N-methyl-N-oleyltaurinedisodium salt of N-alkylsulfosuccinic acid monoamide, petroleum sulfonic acid salts, sulfated tallow, salts of alkyl fatty acid ester sulfates, salts of alkyl sulfuric acid esters, salts of polyoxyethylene alkyl ether sulfates, salts of fatty acid monoglyceride sulfates, salts of polyoxyethylene alkylphenyl ether sulfates, salts of polyoxyethylene styrylphenyl ether sulfates, salts of alkyl phosphates, salts of polyoxyethylene alkyl ether phosphates, salts of polyoxyethylene alkylphenyl ether phosphates, partially saponified styrene/maleic anhydride copolymers, partially saponified olefin/maleic anhydride copolymers, naphthalenesulfonate/formalin condensate; cationic surfactants such as alkylamine salts, quaternary ammonium salts, polyoxyethylene alkylamine salts and polyethylene polyamine derivatives; and amphoteric surfactants such as carboxybetaines, aminocarboxylic acids, sulfobetaines, aminosulfuric acid esters and imidazolines. The term "polyoxyethylene" in the foregoing surfactants can be replaced with "polyoxyalkylene" such as "polyoxymethylene", "polyoxypropylene" and "polyoxybutylene" and these surfactants are also included in the scope of the invention.

Preferred surfactants further include, for instance, fluorine atom-containing surfactants having a perfluoroalkyl group in each molecule. Specific examples thereof are anionic ones such as perfluoroalkylcarboxylic acids, per fluoroalkylsulfonic acid salts and perfluoroalkylphosphoric acid esters; amphoteric ones such as perfluoroalkyl betaines; cationic ones such as perfluoroalkyl trimethyl ammonium salts; and non-ionic ones such as perfluoroalkylamine oxides, perfluoroalkyl ethylene oxide adducts, oligomers containing perfluoroalkyl and hydrophilic groups, oligomers containing perfluoroalkyl and lipophilic groups, oligomers containing perfluoroalkyl, hydrophilic and lipophilic groups and urethane containing perfluoroalkyl and lipophilic groups.

The aforementioned surfactants may be used alone or in combination and the amount thereof preferably ranges from 0.001 to 10% by weight and more preferably 0.01 to 5% by weight on the basis of the weight of the back coat layer.

The back coat layer used in the invention further comprises a dye or a pigment for distinguishing the plate from other kinds of plates. Examples of preferred dyes are triphenylmethane type, diphenylmethane type, oxazine type, xanthene type, iminonaphthoquinone type, azomethine type or anthraquinone type dyes represented by Rhodamine 6G hydrochloride, Rhodamine B hydrochloride, Crystal Violet, Malachite Green oxalate, oxazine-4 perchlorate, quinizarin, 2-(α -naphthyl)-5-phenyloxazole and cumarin-4. Specific examples of other dyes usable in the invention are Oil Yellow #101 and #103, Oil Pink #312, Oil Green BG, Oil Blue BOS and #603, Oil Black BY, BS and T-505 (available from Orient Chemical Industries Co., Ltd.); Victoria Pure Blue, Crystal Violet (CI 42555), Methyl Violet (CI 42535), Ethyl Violet, Methylene Blue (CI 52015), Patent Pure Blue (available from Sumitomo Mikuni Chemical Co., Ltd.), Brilliant Blue, Methyl Green, Erythricin B, Basic Fuchsine, m-Cresol Purple, Auramine, 4-p-diethylaminophenylimi-nonaphthoquinone and cyano-p-diethylaminophenylacetanilide. These dyes or pigments may be used alone or in combination and the amount thereof preferably ranges from about 0.05 to 10% by weight and more preferably about 0.5 to 5% by weight on the basis of the weight of the back coat layer.

The back coat layer of the invention may further comprise an o-naphthoquinonediazide compound, a light-sensitive azide compound, a photopolymerizable composition mainly comprising an unsaturated double bond-containing monomer, a photocrosslinkable composition mainly comprising a cinnamate or dimethylmaleimido group-containing monomer and/or a diazo resin obtained by condensing a diazonium salt monomer or aromatic diazonium salt with a reactive carbonyl group-containing organic condensation agent, in particular, an aldehyde such as formaldehyde or acetaldehyde or an acetal in an acidic reaction medium, for the improvement of the resistance to chemicals.

Among the foregoing o-naphthoquinonediazide compounds known as positive-working light-sensitive compounds, preferred are those detailed below in connection with the "positive-working light-sensitive layer".

Most typical examples of the aromatic diazonium salts are condensates of p-diazodiphenylamine with formaldehyde. Methods for synthesizing these diazo resins are disclosed in, for instance, U.S. Pat. Nos. 2,679,498, 3,050,502, 3,311,605 and 3,277,074.

In addition, preferably used diazonium salts are co-condensed diazonium compounds of aromatic diazonium salts with substituted aromatic compounds free of diazonium group as disclosed in U.S. Pat. No. 3,867,147, in particular, co-condensed diazo compounds of aromatic diazonium salts with aromatic compounds substituted with alkali-soluble groups such as carboxyl and/or hydroxyl groups as described in European Laid-Open Patent No. 0415422A.

Moreover, it is also possible to use diazonium salt compounds obtained by co-condensing aromatic diazonium salts with alkali-soluble group-containing reactive carbonyl compounds as disclosed in U.S. Pat. No. 5,112,743.

There have been known diazonium compounds in which inorganic anions such as those derived from mineral acids, for instance, hydrochloric acid, hydrobromic acid, sulfuric acid and phosphoric acid and those derived from double salts of zinc chloride with these mineral acids are used as the counter anions of these diazonium salts, but particularly preferred are diazonium compounds substantially insoluble in water and soluble in organic solvents. Specific examples of these preferred diazonium compounds are disclosed in U.S. Pat. No. 3,300,309.

Furthermore, preferably used further include, for instance, diazonium compounds whose counter anions are those derived from halogenated Lewis acids such as tetrafluoroboric acid and hexafluorophosphoric acid and perhalogenated acids such as perchloric acid and periodic acid as disclosed in J.P. KOKAI Nos. Sho 54-98613 and Sho 56-121031; and diazonium compounds whose counter anions are those derived from long chain alkyl group-containing sulfonic acids as disclosed in U.S. Pat. No. 3,790,556.

These diazonium compounds are used alone or in combination and the amount thereof preferably ranges from 0.5 to 60% by weight and more preferably 5 to 50% by weight on the basis of the weight of the back coat layer.

The back coat layer may further comprise, as slip agents, higher fatty acids or higher fatty acid amides such as behenic acid, behenic acid amide, stearic acid, stearic acid amide and alkenylsuccinic anhydrides; waxes, dimethylsiloxane and/or polyethylene powder.

Moreover, the back coat layer may comprise, for instance, fine silica powder, colloidal silica, methanol silica sol and/or anhydrous boric acid for the improvement of the hydrophilicity and film-forming properties.

Examples of the colloidal silica sol used in the back coat layer are colloidal solutions of micronized silicic acid particles dispersed in mediums such as water, methanol, ethanol, isopropyl alcohol, butanol, xylene and dimethylformamide, with methanol being particularly preferred as a dispersion medium. The dispersed particles preferably have a particle size ranging from 1 to 100 μm, in particular 10 to 50 μm. If the size thereof is greater than 100 μm, the uniformity of the coated film is impaired due to unevenness of the surface. The content of the silicic acid preferably ranges from 5 to 80% by weight and the colloidal solution preferably has a hydrogen ion concentration outside the neutral range (pH 6 to 8) from the viewpoint of stability. Colloidal solutions having acidic pH are particularly preferred. The silica sol may be used in combination with other sols of fine particles such as an alumina sol or a lithium silicate sol. The simultaneous use of these sols permits further improvement in the hardening properties of the sol-gel coated film. Specifically, the amount of these sols to be added is not less than 30% by weight and not more than 300% by weight, preferably 30 to 200% by weight and more preferably 50 to 100% by weight on the basis of the weight of the starting metal compound. If the added amount thereof exceeds the upper limit, the film-forming ability is impaired and accordingly, the resulting solution cannot be uniformly coated. On the other hand, if it is less than the lower limit, a lipophilic substance is easily adhered to the resulting film. In particular, when the resulting lithographic printing plates to which a PI ink is applied are put in layers, the ink adheres to the surface thereof.

The back coat layer used in the invention must basically have a thickness sufficient for inhibiting any dissolution of the anodized layer from the aluminum substrate of the PS plate during development. Therefore, the thickness thereof preferably ranges from 0.001 to 10 $g/m^2$, more preferably 0.01 to 1 $g/m^2$ and most preferably 0.02 to 0.1 $g/m^2$.

The back coat layer may be applied onto the back face of the aluminum substrate by various methods, but most preferably by a method comprising preparing a solution containing the foregoing components, applying it onto the back face and then drying, in order to ensure the coated amount defined above.

Light-Sensitive Layer

A light-sensitive layer of a known light-sensitive composition is applied onto an aluminum plate having a back coat layer on the back face and a hydrophilized surface to give a PS plate. As the light-sensitive composition, there may be used, for instance, positive-working light-sensitive compositions mainly comprising o-naphthoquinonediazide compounds; and negative-working light-sensitive compositions comprising, as light-sensitive substances, diazonium salts, alkali-soluble diazonium salts, photopolymerizable compounds mainly composed of unsaturated double bond-containing monomers and cinnamate and/or dimethylmaleimido group-containing photocrosslinkable compounds.

A. Positive-Working Light-Sensitive Layer

Examples of o-naphthoquinonediazide compounds used as the principal component of the positive-working light-sensitive composition are esters of 1,2-diazonaphthoquinonesulfonic acid with pyrogallol-acetone resin as disclosed in J.P. KOKOKU No. Sho 43-28403 (U.S. Pat. No. 3,635,709). Other preferred o-quinonediazide compounds are, for instance, esters of 1,2-diazonaphthoquinone- 5-sulfonic acid with phenol-formaldehyde resin as disclosed in U.S. Pat. Nos. 3,046,120 and 3,188,210; and esters of 1,2-diazonaphthoquinone-4-sulfonic acid with phenol-formaldehyde resin as disclosed in J.P. KOKAI Nos. Hei 2-96163, Hei 2-96165 and Hei 2-96761. Examples of other preferred o-naphthoquinonediazide compounds include those known and disclosed in a variety of patents such as J.P. KOKAI Nos. Sho 47-5303, Sho 48-63802, Sho 48-63803, Sho 48-96575, Sho 49- 38701 and Sho 48-13354, J.P. KOKOKU Nos. Sho 37-18015, Sho 41- 11222, Sho 45-9610 and Sho 49-17481, U.S. Pat. Nos. 2,797,213; 3,454,400; 3,544,323; 3,573,917; 3,674,495 and 3,785,825; U.K. Patent Nos. 1,227,602; 1,251,345; 1,267,005; 1,329,888 and 1,330,932; and German Patent No. 854,890.

Particularly preferred o-naphthoquinonediazide compounds are those obtained through the reaction of polyhydroxy compounds having molecular weights of not more than 1,000 with 1,2-diazonaphthoquinonesulfonic acid. Specific examples thereof are those disclosed in, for instance, J.P. KOKAI Nos. Sho 51- 139402, Sho 58-150948, Sho 58-203434, Sho 59-165053, Sho 60- 121445, Sho 60-134235, Sho 60-163043, Sho 61-118744, Sho 62- 10645, Sho 62-10646, Sho 62-153950, Sho 62-178562 and Sho 64-76047; and U.S. Pat. Nos. 3,102,809; 3,126,281; 3,130,047; 3,148,983; 3,184,310; 3,188,210 and 4,639,406.

These o-naphthoquinonediazide compounds are preferably obtained by reacting polyhydroxy compounds with 1,2-diazonaphthoquinonesulfonic acid chloride in an amount ranging from 0.2 to 1.2 eq, more preferably 0.3 to 1.0 eq per hydroxyl group of the former. The 1,2-diazonaphthoquinonesulfonic acid chloride may be either 1,2-diazonaphthoquinone-5-sulfonic acid chloride or 1,2-diazonaphthoquinone-4-sulfonic acid chloride.

In this respect, the resulting o-naphthoquinonediazide compound is a mixture of products variously differing in the positions of 1,2-diazonaphthoquinonesulfonate groups and the amounts thereof introduced, but preferred are those having a rate of the compound whose hydroxyl groups are all converted into 1,2-diazonaphthoquinonesulfonic acid esters (content of the completely esterified compound) of not less than 5 mole %, more preferably 20 to 99 mole %.

The light-sensitive composition used in the invention preferably comprises the positive-working light-sensitive compounds (inclusive of the foregoing combination) in an amount ranging from 10 to 50% by weight and more preferably 15 to 40% by weight.

The positive-working photosensitive composition may comprise only o-quinonediazide compounds such as those listed above, but preferably the o-quinonediazide compounds are used in combination with an alkaline water-soluble resin as a binder. Preferred examples thereof are alkaline water-soluble novolak resins such as phenol-formaldehyde resins and cresol-formaldehyde resins, for instance, o-, m- and p-cresol-formaldehyde resins, m-/p-mixed cresol-formaldehyde resins and phenol-mixed cresol (m-/ p-/o- or m-/p- or m-/o-)-formaldehyde resins.

Other binders usable in the invention further include phenol-modified xylene resins, polyhydroxystyrenes, halogenated polyhydroxystyrenes and acrylic resins having phenolic hydroxyl groups as disclosed in U.S. Pat. No. 5,182,183. Examples of suitable binders may further include copolymers generally having a molecular weight of 10,000 to 200,000 and having structural units derived from the foregoing monomers (1) to (12) listed above as the monomers for preparing polymers added to the back coat layer and (13) unsaturated carboxylic acids such as (meth) acrylic acid, maleic anhydride and itaconic acid.

Further, the foregoing monomers may likewise be copolymerized with other monomers copolymerizable therewith and the copolymers of the monomers listed above can be modified with, for instance, glycidyl (meth)acrylate. However, the copolymers usable in the invention are not limited to these specific examples.

The foregoing copolymers preferably comprise moieties derived from the unsaturated carboxylic acids (13) listed above such as (meth)acrylic acid, maleic anhydride and itaconic acid and the (carboxylic) acid value thereof preferably ranges from 0 to 10 meq/g, more preferably 0.5 to 5 meq/g. Moreover, the preferred molecular weight of these copolymers ranges from 10,000 to 100,000. The copolymers, if desired, may comprise polyvinyl butyral resin, polyurethane resin, polyamide resin and/or epoxy resin.

These alkali-soluble polymers may be used alone or in combination and the amount thereof is not more than 80% by weight on the basis of the total weight of the light-sensitive composition.

Furthermore, it is preferred, for the improvement of the ink-receptivity of images formed, to simultaneously use a condensate of formaldehyde with a phenol carrying, as a substituent, an alkyl group having 3 to 8 carbon atoms such as t-butylphenol/formaldehyde resin or octylphenol/formaldehyde resin as disclosed in U.S. Pat. No. 4,123,279.

The light-sensitive composition used in the invention preferably comprises, for the improvement of sensitivity, cyclic acid anhydrides, phenols and/or organic acids. Examples of such cyclic acid anhydrides are phthalic anhydride, tetrahydrophthalic anhydride, hexahydrophthalic anhydride, 3,6-endoxy-$\Delta^4$ -tetrahydrophthalic anhydride, tetrachlorophthalic anhydride, maleic anhydride, chloromaleic anhydride, α-phenylmaleic anhydride, succinic anhydride and pyromellitic anhydride. Such phenols include, for instance, bisphenol A, p-nitrophenol, p-ethoxyphenol, 2,4,4'-trihydroxybenzophenone, 2,3,4-trihydroxybenzophenone, 4-hydroxy-benzophenone, 4,4',4" -trihydroxy-triphenylmethane and 4,4',3",4"-tetrahydroxy- 3,5,3',5'-tetramethyltriphenylmethane. Such organic acids are, for instance, sulfonic acids, sulfinic acids, alkylsulfuric acids, phosphonic acids, phosphinic acids, phosphoric acid esters and carboxylic acids as disclosed in J.P. KOKAI Nos. Sho 60-88942 and Hei 2-96755 and specific examples thereof are p-toluenesulfonic acid, dodecylbenzenesulfonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluylic acid, 3,4-dimethoxybenzoic acid, phthalic acid, terephthalic acid, 1,4-cyclohexene-2,2-dicarboxylic acid, erucic acid, lauric acid, n-undecanoic acid and ascorbic acid.

The content of the foregoing cyclic acid anhydrides, phenols and/or organic acid in the light-sensitive composition preferably ranges from 0.05 to 15% by weight and more preferably 0.1 to 5% by weight.

The composition used in the invention may further comprise, for extending the development latitude, non-ionic surfactants as disclosed in J.P. KOKAI Nos. Sho 62-251740, Hei 2-96760 and Hei 4-68355 and/or amphoteric surfactants as disclosed in J.P. KOKAI Nos. Sho 59-121044 and Hei 4-13149. Specific examples of non-ionic surfactants are sorbitan tristearate, sorbitan monopalmitate, sorbitan trioleate, srearyl monoglyceride, polyoxyethylene sorbitan monooleate and polyoxyethylene nonylphenyl ether and examples of amphoteric surfactants are alkyl di(aminoethyl)glycine, alkyl polyaminoethyl glycine hydrochloride, 2-alkyl-N-carboxyethyl-N-hydroxyethyl imidazolinium betaine and Amorgen K (trade name of an N-tetradecyl-N, N-betaine type surfactant, available from Dai-Ichi Kogyo Seiyaku Co., Ltd.) and Rebon 15 (trade name of an alkyl imidazoline type one available from Sanyo Chemical Industries, Ltd.).

The content of the foregoing non-ionic and/or amphoteric surfactants in the composition preferably ranges from 0.05 to 15% by weight and more preferably 0.1 to 5% by weight.

The positive-working light-sensitive composition used in the invention may comprise a printing out agent for obtaining a visible image immediately after exposure to light, a dye or pigment for coloring images. A representative example of the printing out agent is a combination of a compound capable of releasing an acid through exposure to light with a salt-forming organic dye, for instance, a combination of o-naphthoquinonediazido-4-sulfonic acid halide with a salt-forming organic dye as disclosed in J.P. KOKAI Nos. Sho 50-36209 (=U.S. Pat. No. 3,969,118) and Sho 53-8128; and a combination of a trihalomethyl compound with a salt-forming organic dye as disclosed in J.P. KOKAI Nos. Sho 53-36223 (=U.S. Pat. No. 4,160,671), Sho 54-74728 (=U.S. Pat. No. 4,232,106), Sho 60-3626, Sho 61-143748, Sho 61-151644 and Sho 63-58440 (=U.S. Pat. No. 5,064,741). Such trihalomethyl compounds include oxadiazole and triazine type compounds and both of these are excellent in stability with time and can provide clear printed out images.

Other dyes may also be used instead of or together with the foregoing salt-forming organic dyes as the agents for coloring images. Preferred dyes inclusive of the salt-forming organic dyes are, for instance, oil-soluble and basic dyes. Specific examples thereof are Oil Yellow #101 and #103, Oil Pink #312, Oil Green BG, Oil Blue BOS and #603, Oil Black BY, BS and T-505 (they are all available from Orient Chemical Industries, Co., Ltd.), Victoria Pure Blue, Crystal Violet (CI 42555), Methyl Violet (CI 42535), Ethyl Violet, Rhodamine B (CI 145170B), Malachite Green (CI 42000) and Methylene Blue (CI 52015). Particularly preferred are those disclosed in J.P. KOKAI No. Sho 62-293247 (=GB 2192729).

The foregoing components of the positive-working light-sensitive composition are dissolved in a solvent and applied to the surface of an aluminum plate as a substrate. The solvent used herein is, for instance, organic solvents as disclosed in U.S. Pat. No. 4,764,450 which may be used alone or in combination.

The positive-working light-sensitive composition is dissolved and dispersed in the solvent in a concentration (solid content) ranging from 2 to 50% by weight, applied onto the substrate and then dried.

The coated amount of the positive-working light-sensitive composition layer (light-sensitive layer) applied onto the substrate varies depending on the applications of the resulting plate, but preferably ranges from 0.3 to 4.0 g/m$^2$ (weighed after drying). As the coated amount decreases, the quantity of light required for imagewise exposure is reduced, but the film strength is lowered. On the other hand, as it is increased, the quantity of light required for imagewise exposure is increased, but the film strength is increased. For instance, when the resulting plate is used as a lithographic printing plate, high printing durability (large number of acceptable copies) can be ensured.

The positive-working light-sensitive composition may comprise a surfactant such as a fluorine atom-containing surfactant as disclosed in J.P. KOKAI No. Sho 62-170950 (=U.S. Pat. No. 4,822,713) for improving the coating properties thereof. The amount thereof to be added preferably ranges from 0.001 to 1.0% by weight and more preferably 0.005 to 0.5% by weight on the basis of the total weight of the composition.

Negative-Working Light-Sensitive Composition

Examples of light-sensitive compositions used in the negative-working PS plates to which the back coat layer discussed above is applied are light-sensitive compositions comprising light-sensitive diazo compounds, photopolymerizable light-sensitive compositions and photocrosslinkable light-sensitive compositions. Among these, photohardenable light-sensitive compositions will be detailed below by way of example.

The light-sensitive diazo compounds preferably used in the negative-working PS plates of the invention are, for instance, diazo resins obtained through condensation of aromatic diazonium salts with reactive carbonyl group-containing organic condensation agents, in particular, aldehydes such as formaldehyde and acetaldehyde or acetals in acidic mediums, with a condensate of p-diazodiphenylamine with formaldehyde being the most typical example thereof. Methods for synthesizing these diazo resins are detailed in, for instance, U.S. Pat. Nos. 2,679,498; 3,050,502; 3,311,605 and 3,277,074.

Moreover, preferred light-sensitive diazo compounds further include, for instance, co-condensed diazo compounds obtained by co-condensing aromatic diazonium salts with substituted aromatic compounds free of diazonium group as disclosed in U.S. Pat. No. 3,867,147, in particular, co-condensed diazo compounds of aromatic diazonium salts with aromatic compounds substituted with alkali-soluble group such as carboxyl and/or hydroxyl groups. Preferably used light-sensitive diazo compounds further include, for instance, those obtained through condensation of reactive carbonyl compounds carrying alkali-soluble groups with aromatic diazonium salts as disclosed in U.S. Pat. No. 5,112,743.

There have been known diazo resins in which the counter anions of these diazonium salts are inorganic anions such as those derived from mineral acids, e.g., hydrochloric acid, hydrobromic acid, sulfuric acid and phosphoric acid or complex salts thereof with zinc chloride. However, particularly preferred are diazo resins which are substantially insoluble in water and soluble in organic solvents. Such preferred diazo resins are detailed in U.S. Pat. No. 3,300,309.

Moreover, preferred diazo resins further include, for instance, those having counter anions derived from halogenated Lewis acids such as tetrafluoroboric acid and hexafluorophosphoric acid, and perhalogenic acids such as perchloric acid and periodic acid as disclosed in J.P. KOKAI Nos. Sho 54-98613 and Sho 56-121031. In addition, preferred are also include diazo resins having counter anions derived from sulfonic acid carrying long chain alkyl groups as disclosed in U.S. Pat. No. 3,790,556.

The amount of the light-sensitive diazo compounds used in the composition usually ranges from 5 to 50% by weight and preferably 8 to 20% by weight on the basis of the total weight of the light-sensitive layer.

The light-sensitive diazo compounds used in the invention are preferably used in combination with alkaline water-soluble or swellable lipophilic polymer materials as binders.

Examples of such lipophilic polymeric compounds are the same copolymers listed above in connection with the positive-working light-sensitive composition and having repeating units derived from the monomers (1) to (13) and molecular weights generally ranging from 10,000 to 200,000 as well as those having repeating units derived from the following monomers (14) and (15):

(14) unsaturated imides such as maleimide, N-acryloyl-(meth) acrylamide, N-acetyl(meth)acrylamide, N-propionyl(meth) acrylamide and N-(p-chlorobenzoyl)(meth)acrylamide.

(15) unsaturated monomers having, on the side chains, crosslinkable groups such as N-[6-(acryloyloxy)hexyl]-2,3-dimethylmaleimide, N-[2-(methacryloyloxy)hexyl]-2,3-dimethylmaleimide and vinyl cinnamate.

Further, other monomers copolymerizable with the foregoing monomers may be copolymerized. Moreover, the binders also include copolymers obtained by copolymerization of the foregoing monomers which are further modified with glycidyl (meth)acrylate. However, the present invention is not restricted to these specific binders.

The foregoing copolymers preferably comprises moieties derived from the unsaturated carboxylic acids (13) listed above and the acid value thereof preferably ranges from 0 to 10 meq/g, more preferably 0.2 to 5.0 meq/g. Moreover, preferred molecular weight of these copolymers ranges from 10,000 to 100,000. The copolymers, if desired, may comprise polyvinyl butyral resin, polyurethane resin, polyamide resin and/or epoxy resin.

These alkali-soluble polymers may be used alone or in combination and the amount thereof usually ranges from 40 to 95% by weight based on the total weight of the solid contents of the light-sensitive composition.

The negative-working light-sensitive composition used in the invention may optionally comprise an ink receptivity-imparting agent such as a styrene/maleic anhydride copolymer half-esterified with an alcohol, a novolak resin and/or a 50% fatty acid ester of p-hydroxystyrene as disclosed in U.S. Pat. No. 4,294,905, for improving the ink receptivity of images.

The negative-working light-sensitive composition used in the invention may optionally comprise a plasticizer for improving the flexibility and wear resistance of the resulting coating layer. Specific examples thereof are butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate and oligomers and polymers of (meth) acrylic acid, with tricresyl phosphate being particularly preferred.

The negative-working light-sensitive composition used in the invention may comprise, for the improvement of stability with time, additives such as phosphoric acid, phosphonic acid, citric acid, oxalic acid, dipicolinic acid, benzenesulfonic acid, naphthalenesulfonic acid, sulfosalicylic acid, 4-methoxy- 2-hydroxybenzophenone-5-sulfonic acid and tartaric acid.

The negative-working light-sensitive composition used in the invention may comprise printing out agent for obtaining a visible image immediately after imagewise exposure to light and/or agents for coloring images such as dyes or pigments.

Representative printing out agents are combinations of compounds releasing acids through exposure to light (photolytically acid-releasing agents) with salt-forming organic dyes. Specific examples thereof are combinations of trihalomethyl compounds with salt-forming organic dyes as disclosed in J.P. KOKAI Nos. Sho 53-36223 (=U.S. Pat. No. 4,160,671), Sho 54-74728 (=U.S. Pat. No. 4,232,106), Sho 60-3626, Sho 61-143748, Sho 61-151644 and Sho 63-58440 (=U.S. Pat. No. 5,064,741). Such trihalomethyl compounds include oxazole and triazine type compounds and both of these are excellent in stability with time and can provide clear printed out images.

The dyes are preferably those which change color tone through the reaction with free radicals or acids. Specific examples thereof which are initially colored and converted into colorless ones, or which cause color change are triphenylmethane, diphenylmethane, oxazine, xanthene, iminonaphthoquinone, azomethine or anthraquinone type dyes such as oil-soluble and basic dyes. Specific examples thereof are Victoria Pure Blue BOH (available from Hodogaya Chemical Co., Ltd.), Oil Yellow #101 and #103, Oil Pink #312, Oil Red, Oil Green BG, Oil Blue BOS and #603, Oil Black BY, BS and T-505 (they are all available from Orient Chemical Industries, Co., Ltd.), Patent Pure Blue (available from Sumitomo Mikuni Chemical Co., Ltd.), Crystal Violet (CI 42555), Methyl Violet (CI 42535), Ethyl Violet, Rhodamine B (CI 145170B), Malachite Green (CI 42000), Methylene Blue (CI 52015), Brilliant Blue, Methyl Green, Erythrosine B, Basic Fuchsine, m-Cresol Purple, Auramine, 4-p-diethylaminophenyl iminonaphthoquinone, cyano-p-diethylaminophenyl acetanilide.

On the other hand, examples of dyes which are initially colorless and converted into colored ones are leuco dyes and primary and secondary arylamine type dyes such as triphenylamine, diphenylamine, o-chloroaniline, 1,2,3-triphenylguanidine, naphthylamine, diaminodiphenylmethane, p,p'-bis-dimethylaminodiphenylamine, 1,2-dianilinoethylene, p,p',p"-tris-dimethylaminotriphenylmethane, p,p'-bis-dimethylaminodiphenylmethylimine, p,p',p"-triamino-o-methyltriphenylmethane, p,p'-bis-dimethylaminodiphenyl-4-anilinonaphthylmethane and p,p',p"-triaminotriphenylmethane.

Preferred are triphenylmethane and diphenylmethane type dyes, more preferred are triphenylmethane type dyes, in particular Victoria Pure Blue BOH. The foregoing dyes are used in an amount preferably ranging from about 0.5 to 10% by weight, more preferably about 1 to 5% by weight based on the total weight of the negative-working light-sensitive composition.

The negative-working light-sensitive composition used in the invention may comprise cyclic acid anhydrides, phenols, organic acids and/or higher alcohols, for the improvement of the developability of the resulting PS plate. These additives are the same as those listed above in connection with the positive-working light-sensitive composition and used in the same amount defined above.

The negative-working light-sensitive composition is dissolved in a solvent in which the foregoing components are soluble and then applied onto the aluminum substrate detailed above. Examples of such solvents used herein are preferably organic solvents disclosed in, for instance, U.S. Pat. Nos. 4,917,988 and 4,929,533.

The negative-working light-sensitive composition is dissolved or dispersed in the solvent in a concentration ranging from 2 to 50% by weight (solid content), applied to the substrate and then dried. The coated amount of the layer of the negative-working light-sensitive composition (light-sensitive layer) applied onto the substrate varies depending on the applications of the resulting plates, but preferably ranges from 0.3 to 4.0 g/m$^2$ (weighed after drying). As the coated amount decreases, the quantity of light required for imagewise exposure is reduced, but the strength of the resulting film is lowered. On the other hand, as it is increased, a large quantity of light is required for imagewise exposure, but the resulting film has high strength. For instance, the composition can provide a lithographic printing plate having high printing durability, i.e., capable of providing a large number of acceptable copies.

The negative-working light-sensitive composition may comprise a surfactant, like the positive-working light-sensitive composition discussed above, for improving the coating properties thereof.

In the preparation of the PS plate of the invention, the back coat layer may be applied to the back face of a substrate prior to the application of the light-sensitive layer to the surface thereof or vice versa, or both of these layers may simultaneously be applied to the corresponding faces.

Mat Layer

A mat layer is applied onto the surface of the light-sensitive layer thus formed to reduce the time required for evacuation during contact exposure using a vacuum printing frame and to prevent the formation of an indistinct image during printing. Examples of such mat layers are disclosed in U.S. Pat. Nos. 4,268,611; 4,288,526 and 4,626,484. Alternatively, the mat layer can also be formed by heat-welding solid powder onto the surface of the light-sensitive layer as disclosed in U.S. Pat. No. 5,028,512. The intended effects of the present invention are more conspicuous in the PS plates having mat layers soluble in water and soluble in aqueous alkaline developers.

The mat layer used in the invention comprises projections preferably having an average diameter of not more than 100 μm. This is because if it exceeds 100 μm, the contact area between the light-sensitive and the back coat layer increases upon storing a plurality of the PS plates put in piles and this in turn leads to reduction of slip properties and easy formation of scratch marks on the surfaces of these layers. The height of the projections is preferably not more than 10 μm and more preferably 2 to 8 μm on the average. If the average height thereof is greater than the upper limit, it is difficult to form hairline images, dot numbers on a highlight dot image is reduced and this results in insufficient tone reproduction. On the other hand, if it is less than 2 μm, the adhesion under vacuum is insufficient and this in turn leads to the formation of an indistinct image during printing. The amount of the mat layer to be applied preferably ranges from 5 to 200 $mg/m^2$ and more preferably 20 to 150 $mg/m^2$. If it is greater than the upper limit, the contact area between the light-sensitive and the back coat layer increases and this in turn becomes a cause of the formation of scratch makes on the surfaces of these layers, while if it is less than the lower limit, the adhesion under vacuum becomes insufficient.

Development Processing

The PS plate thus prepared is imagewise exposed, through an original transparency, to actinic light from a light source such as a carbon arc lamp, a mercury lamp, a xenon lamp, a tungsten lamp or a metal halide lamp and then developed.

Alkali aqueous solutions commonly known can be used as developers for the development processing. Examples of the alkaline agents used in the developer include inorganic alkaline agents such as sodium silicate, potassium silicate, sodium tertiary phosphate, potassium tertiary phosphate, sodium secondary phosphate, potassium secondary phosphate, ammonium tertiary phosphate, ammonium secondary phosphate, sodium carbonate, potassium carbonate, ammonium carbonate, sodium bicarbonate, potassium bicarbonate, ammonium bicarbonate, sodium borate, potassium borate, ammonium borate, sodium hydroxide, potassium hydroxide, lithium hydroxide and ammonium hydroxide; and organic alkaline agents such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine and pyridine. In the invention, these alkaline agents may be employed alone or in combination.

Among the foregoing aqueous alkali solutions used as developers, aqueous solutions of alkali metal silicates having a pH of not less than 12 ensure the optimum effects of the present invention. This is because the developing ability of the developer can be controlled, to some extent, by adjusting the ratio of the silicon oxide $SiO_2$ to the alkali metal oxide $M_2O$ which are components of the silicate (in general expressed in terms of the molar ratio: $[SiO_2]/[M_2O]$) and the concentration of the silicate. Examples of such developers are aqueous solutions of sodium silicate having a molar ratio: $SiO_2/Na_2O$ of 1.0 to 1.5 (i.e., $[SiO_2]/[Na_2O]$ ranging from 1.0 to 1.5) and an $SiO_2$ content of 1 to 4% by weight as disclosed in U.S. Pat. No. 4,259,434; and aqueous alkali metal silicate solutions having a ratio: $[SiO_2]/[M]$ of 0.5 to 0.75 (i.e., $[SiO_2]/[M_2O]$ of 1.0 to 1.5) and an $SiO_2$ content of 1 to 4% by weight and containing at least 20% of potassium on the basis of the total gram atoms of the alkali metals present in the developer as disclosed in U.S. Pat. No. 4,259,434.

When the PS plates are developed with an automatic developing machine, it has been known that many PS plates can be processed over a long time without exchanging the developer in the developing tank if an aqueous solution (replenisher) having an alkalinity higher than that of the developer is added to the developer. It is also preferred to adopt this replenishment in the present invention. For instance, there can preferably be used a method which comprises using an aqueous solution of sodium silicate having a molar ratio: $SiO_2/Na_2O$ of 1.0 to 1.5 (i.e., $[SiO_2]/[Na_2O]$ ranging from 1.0 to 1.5) and an $SiO_2$ content of 1 to 4% by weight as a developer and continuously or intermittently adding an aqueous solution of sodium silicate (replenisher) having a molar ratio: $SiO_2/Na_2O$ of 0.5 to 1.5 (i.e., $[SiO_2]/[Na_2O]$ ranging from 1.0 to 1.5) in proportion to the amount of the positive-working PS plates processed as disclosed in U.S. Pat. No. 4,259,434; and a method which uses an aqueous alkali metal silicate solution having a ratio: $[SiO_2]/[M]$ of 0.5 to 0.75 (i.e., $[SiO_2]/[M_2O]$ of 1.0 to 1.5) and an $SiO_2$ content of 1 to 4% by weight as a developer and an aqueous alkali metal silicate solution having a ratio: $[SiO_2]/[M]$ of 0.25 to 0.75 (i.e., $[SiO_2]/[M_2O]$ of 0.5 to 1.5) as a replenisher, both developer and replenisher containing at least 20% of potassium on the basis of the total gram atoms of the alkali metals present in the developer or the replenisher, as disclosed in U.S. Pat. No. 4,259,434.

When an alkali metal silicate solution is used as such a replenisher, the activity of the replenisher can be increased and the amount thereof to be supplemented can be decreased by reducing the molar ratio: $[SiO_2]/[M_2O]$ of the alkali metal silicate. This, accordingly, results in the reduction of the running cost and the amount of waste liquor. However, it has been known that the use of highly active replenisher is accompanied by the dissolution of the aluminum substrate of the PS plate in the developer and hence the formation of insolubles therein. Nevertheless, the back coat layer of the PS plate serves to prevent any dissolution of aluminum from the back face of the substrate and, accordingly, the PS plate can preferably be processed with a highly active replenisher system. Examples of such highly active developers are aqueous solutions of alkali metal silicates each having a molar ratio, $SiO_2/M_2O$, ranging from 0.7 to 1.5 and an $SiO_2$ content ranging from 1.0 to 4.0% by weight.

In addition, preferred replenishers are aqueous solutions of alkali metal silicates each having a molar ratio, $SiO_2/M_2O$, ranging from 0.3 to 1.0 and an $SiO_2$ content ranging from 0.5 to 4.0% by weight and more preferably aqueous solutions of alkali metal silicates each having a molar ratio, $SiO_2/M_2O$, ranging from 0.3 to 0.6 and an $SiO_2$ content ranging from 0.5 to 2.0% by weight. If the molar ratio, $SiO_2/M_2O$, of the replenisher is less than 0.3, the anodized layer on the non-image area (from which the light-sensitive layer is removed through development) on the light-sensitive layer-carrying side of the aluminum substrate is substantially dissolved and thus the formation of insolubles cannot be inhibited. On the other hand, if it exceeds 1.0, the resulting replenisher has a low activity and the development requires the use of a large amount of the replenisher. Moreover, if the $SiO_2$ content is less than 0.5% by weight, insolubles are easily formed, while if it exceeds 4.0% by weight, a large amount of silica gel is formed during the neutralization of the used developer (waste liquor).

The developer and replenisher used in the development of the positive-working and negative-working PS plates of the invention may optionally comprise various kinds of surfactants and/or organic solvents, for controlling the developability, for dispersing scum formed during development and for improving the ink receptivity of images on the resulting printing plate. Surfactants preferably used herein are anionic, cationic, nonionic and amphoteric ones.

Examples of surfactants preferably used are those listed above in connection with the back coat layer, with organic boron-containing surfactants disclosed in U.S. Pat. No. 4,500,625 being particularly preferred. The foregoing surfactants may be used alone or in combination and the amount thereof added to the developer preferably ranges from 0.001 to 10% by weight and more preferably 0.01 to 5% by weight.

The organic solvents which may be added to the developer are preferably selected from those having solubility in water of not more than about 10% by weight, in particular not more than 5% by weight. Examples of the organic solvent include 1-phenylethanol, 2-phenylethanol, 3-phenyl-1-propanol, 4-phenyl-1-butanol, 4-phenyl-2-butanol, 2-phenyl-1-butanol, 2-phenoxyethanol, 2-benzyloxyethanol, o-methoxybenzyl alcohol, m-methoxybenzyl alcohol, p-methoxybenzyl alcohol, benzyl alcohol, cyclohexanol, 2-methylcyclohexanol, 4-methylcyclohexanol, 3-methylcyclohexanol, N-phenyl ethanolamine and N-phenyl diethanolamine.

The amount of the organic solvents preferably ranges from 0.1 to 5% by weight with respect to the total weight of the developer practically employed. The amount of the organic solvent is closely related to that of the surfactant. More specifically, the amount of the surfactant should be increased with the increase in that of the organic solvent. This is because if the amount of the surfactant is low and that of the organic solvent is great, the organic solvent is not completely solubilized in water and as a result, good developing properties of the composition cannot be ensured.

The developer and replenisher used for the development of the PS plate of the invention may further comprise a reducing agent for preventing the contamination of the resulting lithographic printing plate and this is particularly effective in the development of the negative-working PS plate comprising a light-sensitive diazonium salt. Examples of reducing agents preferably used are organic reducing agents, for instance, phenolic compounds such as thiosalicylic acid, hydroquinone, Metol, methoxyquinone, resorcin and 2-methylresorcin; amine compounds such as phenylenediamine and phenyl hydrazine; and inorganic reducing agents such as sodium, potassium and ammonium salts of inorganic acids such as sulfinic acid, hydrosulfurous acid, phosphorous acid, hydrogenphosphorous acid, dihydrogenphosphorous acid, thiosulfuric acid and dithionous acid. Among these, those having particularly excellent effect of preventing contamination are sulfites. These reducing agents are preferably used in an amount ranging from 0.05 to 5% by weight on the basis of the weight of the developer practically employed.

The developer and replenisher may also comprise organic carboxylic acids. Preferred are aliphatic and aromatic carboxylic acids having 6 to 20 carbon atoms. Specific examples of the aliphatic carboxylic acids are caproic acid, enanthlic acid, caprylic acid, lauric acid, myristic acid, palmitic acid and stearic acid with the alkanoic acids having 8 to 12 carbon atoms being particularly preferred. These aliphatic acids may be unsaturated ones having, in the carbon chain, double bonds or those having branched carbon chains.

Examples of the aromatic carboxylic acids are compounds having carboxyl groups on the aromatic rings such as benzene, naphthalene and anthracene rings, for instance, o-chlorobenzoic acid, p-chlorobenzoic acid, o-hydroxybenzoic acid, p-hydroxybenzoic acid, o-aminobenzoic acid, p-aminobenzoic acid, 2,4-dihydroxybenzoic acid, 2,5-dihydroxybenzoic acid, 2,6-dihydroxybenzoic acid, 2,3-dihydroxybenzoic acid, 3,5-dihydroxybenzoic acid, gallic acid, 1-hydroxy-2-naphthoic acid, 3-hydroxy-2-naphthoic acid, 2-hydroxy-1-naphthoic acid, 1 -naphthoic acid and 2-naphthoic acid, with the hydroxynaphthoic acids being particularly effective.

The foregoing aliphatic and aromatic carboxylic acids are preferably used in the form of sodium, potassium or ammonium salt for improving the solubility thereof in water. The amount of the organic carboxylic acids used in the developer is not restricted to a particular range. However, if they are used in an amount of less than 0.1% by weight, the desired effect thereof is not anticipated, while if they are used in an amount of more than 10% by weight, any further effect thereof is not anticipated and if other additives are simultaneously used, they interrupt the dissolution thereof. Therefore, the amount of the carboxylic acids preferably ranges from 0.1 to 10% by weight and more preferably 0.5 to 4% by weight on the basis of the total weight of the developer practically used.

The developer and replenisher used in the invention may optionally comprise conventionally well-known additives such as antifoaming agents and/or water softeners. Examples of water softeners include polyphosphoric acids and sodium, potassium and ammonium salts thereof; polyaminocarboxylic acids and salts thereof such as ethylenediaminetetraacetic acid, diethylenetriaminepentaacetic acid, triethylenetetraminehexaacetic acid, hydroxyethylethylenediaminetriacetic acid, nitrilotriacetic acid, 1,2-diaminocyclohexanetetraacetic acid and 1,3-diamino-2-propanoltetraacetic acid, and ammonium, potassium and sodium salts thereof; aminotri(methylenephosphonic acid), ethylenediaminetetra(methylenephosphonic acid), diethylenetriaminepenta(methylenephosphonic acid), triethyl-enetetraminehexa(methylenephosphonic acid), hydroxyethylethylenediaminetri(methylenephosphonic acid) and 1-hydroxyethane-1,1-diphosphonic acid, and ammonium, potassium and sodium salts thereof.

The optimum amount of the water softener varies depending on the chelating ability of a specific softener, the hardness and the amount of hard water used, but the amount thereof in general ranges from 0.01 to 5% by weight and preferably 0.01 to 0.5% by weight on the basis of the total weight of the developer practically used. If the amount of the softener is less than the lower limit, the desired effect cannot be anticipated, while if it exceeds the upper limit, images are adversely affected and cause color blinding or the like.

The balance of the developer and replenisher used in the invention is water, but they may optionally comprise other various additives commonly known in the art.

It is preferred to prepare the developer and replenisher in the form of stock solutions having contents of the components higher than those practically used and diluted prior to use from the viewpoint of transportation. In this case, the contents are preferably selected such that each component does not cause separation and precipitation.

In the method for developing the PS plate according to the present invention, a replenisher is added to a developer in an amount sufficient for compensating the components of the developer consumed in proportion to the quantity of the processed PS plates and the alkali components thereof carried over by the processed PS plates through adhesion and/or neutralized by the carbon dioxide in the air.

For instance, when the PS plate is developed in an automatic developing machine wherein the plate is processed while conveying it with rollers, the supplementation of a replenisher is advantageously performed by a method comprising adding a replenisher in an amount proportional to the length of a PS plate to be processed along the conveying direction as disclosed in U.K. Patent No. 2,046,931; a method comprising adding a replenisher in an amount proportional to the surface area of the PS plate processed; or a method comprising a combination of the foregoing method with a method in which a replenisher is intermittently added in an amount proportional to the operation time of a pump for circulating the developer. Also preferred is a method which comprises determining the electric conductance or impedance of a developer and adding a replenisher in response to the measured value as disclosed in U.S. Pat. No. 4,882,246 and European Patent No. 107,454.

The addition of a replenisher is performed in order to compensate any change in the components of a developer with time and/or in proportion to the quantity of the processed positive-working PS plate and to compensate the amount of the developer carried over by the processed PS plates, irrespective of the means for supplementing the replenisher.

The PS plate thus developed is post-treated with, for instance, a rinse solution comprising, for instance, washing-water and a surfactant and/or a desensitizing solution comprising, for instance, gum arabic and a starch derivative, as disclosed in J.P. KOKAI Nos. Sho 54-8002 and Sho 59-58431 and U.S. Pat. No. 4,291,117. In the post-treatment of the PS plate, the post-treatments may be used in any combination.

Recently, automatic developing machines for PS plate have widely been used in the fields of plate-making and printing for rationalizing and standardizing plate-making operations. The automatic developing machine in general comprises a developing zone and a post-treating zone and more specifically comprises a device for conveying PS plates, baths for accommodating processing solutions required and a spray device, in which imagewise exposed PS plates are developed by spraying each processing solution pumped up on the plates through a spray nozzle while horizontally conveying the plates. Alternatively, there has recently been known a method for processing PS plates by dipping them in a processing bath filled with a processing solution while conveying them by means of guide rolls dipped in the processing solution and such processing is preferably performed in an automatic developing machine as disclosed in U.S. Pat. Nos. 4,952,958 and 5,138,353. In these automatic developing treatments, the treatments can be performed while supplementing a replenisher for each corresponding processing solution in an amount proportional to the quantity of PS plates to be processed and the operation time.

Moreover, the PS plate of the present invention may likewise be processed by the so-called disposable processing in which the PS plates are treated in a substantially unused processing solution.

The lithographic printing plate prepared through the foregoing treatment is fitted to an offset printing press to give a large number of copies.

The PS plate and the method for processing the plate according to the present invention permit the reduction in the amount of a replenisher for developer and stable processing of a large amount of the PS plates over a long time without forming insolubles in the developer.

Moreover, the method allows the formation of lithographic printing plates which are free of adhesion to one another and peeling off of the light-sensitive layers upon putting them in layers.

Furthermore, the lithographic printing plate prepared by the present invention never causes contamination of the back face with lipophilic substances such as developing inks through adhesion.

The present invention will hereinafter be explained in more detail with reference to the following non-limitative working Examples and the effect practically accomplished by the invention will also be discussed in detail in comparison with Comparative Examples. All "%" are by weight, unless otherwise indicated.

Example 1 and Comparative Examples 1 to 3

An aluminum plate having a thickness of 0.30 mm was surface-grained with a nylon brush and an aqueous suspension of 400 mesh pumice stone and then sufficiently washed with water. After etching the plate by immersing in a 10% sodium hydroxide solution at 70° C. for 60 seconds and washing with running water, the plate was neutralized and washed with a 20% $HNO_3$ solution and then washed with water. Then the plate was electrolytically surface-roughened in a 1% aqueous solution of nitric acid at an anodic voltage, $V_A$, of 12.7 V such that the quantity of electricity at the anode time was 160 coulomb/dm$^2$ using a sinusoidal alternating wave current. At this stage, the surface roughness thereof was determined to be 0.6μ (expressed in terms of the Ra unit). Then it was desmutted by immersing in a 30% aqueous solution of sulfuric acid at 55° C. for 2 minutes and anodized in a 20% aqueous solution of sulfuric acid at a current density of 2 A/dm$^2$, while a cathode was positioned face to face with the grained surface, so that the thickness of the resulting anodized layer was 2.7 g/m$^2$ to give a substrate D. At this stage, the anodized layer formed on the back face of the substrate D had a thickness of about 0.2 g/m$^2$ at the central portion and about 0.5 g/m$^2$ at the periphery.

Then the following sol-gel reaction solution was applied onto the back face of the substrate D with a bar coater and dried at 100° C. for one minute to give a substrate A having a back coat layer of 50 mg/m$^2$ (weighed after drying).

| Sol-Gel Reaction Solution | |
|---|---|
| Component | Amount (parts by weight) |
| tetraethylsilicate | 50 |
| water | 21.6 |
| methanol | 10.8 |
| nitric acid | 0.05 |

The foregoing components were mixed and stirred and about 5 minutes thereafter, the mixture generated heat. After reacting them for 10 minutes, 700 parts by weight of methanol was added to give a back coat-coating solution.

By way of comparison, a solution for back coat comprising an organic polymer compound was prepared by dissolving 3.0 parts by weight of a saturated copolymerized polyester resin (trade name: CHEMIT K-1294 available from Toray Industries, Inc.) in 100 parts by weight of methyl ethyl ketone and then dissolving 0.05 part by weight of Megafack F-177 (a fluorine atom-containing surfactant available from Dainippon Ink and Chemicals, Inc.) and the resulting solution was applied onto the back face of the substrate D in a thickness of 200 mg/m$^2$ (determined after drying) to give a substrate B.

Separately, an aqueous solution of sodium silicate having an $SiO_2$ content of 0.4% by weight was fed to the back face of the foregoing substrate through a shower nozzle and then the substrate was treated at 90° C. for 10 seconds, by way of comparison. After washing with water, an aqueous sodium hydroxide solution (pH 8) was fed to the back face through a shower nozzle followed by a treatment at 85° C. for 10 seconds, water-washing and drying to give a substrate C.

Then the following light-sensitive solution was applied onto the surface of Substrate A, B, C or D and then dried to give a light-sensitive layer in an amount of 2.5 g/m$^2$ (weighed after drying).

| Light-sensitive Solution | |
|---|---|
| Component | Amount (parts by weight) |
| ester of 1,2-diazonaphthoquinone-5-sulfonyl chloride with pyrogallol/acetone resin (compound described in Example 1 of U.S. Pat. No. 3,635,709) | 45 |
| cresol/formaldehyde novolak resin | 110 |
| 2-(p-methoxyphenyl)-4,6-bis(trichloromethyl)-s-triazine | 2 |
| Oil Blue #603 (available from Orient Chemical Industry Co., Ltd.) | 1 |
| Megafac F-177 (a fluorine atom-containing surfactant available from Dainippon Ink and Chemicals, Inc.) | 0.4 |
| methyl ethyl ketone | 100 |
| propylene glycol monomethyl ether | 100 |

A mat layer was formed on each light-sensitive layer thus formed on Substrate A, B, C or D by spraying a mat layer-forming resin solution on the light-sensitive layer in the following manner to give each corresponding PS plate a, b, c or d.

There was prepared, as the mat layer-forming resin solution, a 12% aqueous solution of a methyl methacrylate/ethyl acrylate/acrylic acid (charge weight ratio 65:20:15) which had been partially converted into sodium salt, then the solution was applied onto the light-sensitive layer using a rotary atomization-electrostatic coating machine under conditions of an atomization head-revolution number of 25,000 rpm, a resin solution-feed rate of 40 ml/min, a voltage applied to the atomization head of −90 KV, an ambient temperature during coating of 25° C. and a relative humidity of 50%. The coated surface was swollen by spraying steam on the surface 2.5 seconds after the application of the resin solution and dried by blowing, for 5 seconds, hot air having a temperature of 60° C. and a humidity of 10% on the surface 3 seconds after the swelling. The mat layer formed comprised projections having an average height of about 6 μm and an average diameter of about 30 μm and the coated amount thereof was found to be 150 mg/m$^2$.

These four kinds of the PS plates thus prepared each was allowed to stand, over 5 months, in the form favorable for bulk transportation formed by putting 1,500 sheets of each kind of the PS plate in layers, sandwiching between two cauls of iron and fastening with bolts. Then the bolts were unfastened to determine whether these plates were adhered to one another or not and whether each light-sensitive layer was peeled off or not. The results are summarized in the following Table 1. For the sake of reference, the contact angles (water droplet in air) observed for the back face of each PS plate prior to and after the development were also determined and listed in Table 1. Any problem did not arise except that adhesion and peeling off of light-sensitive layers were observed for the PS plate c having a hydrophilic back face.

Then each PS plate was cut into a large number of sheets having a size of 1,003 mm× 800 mm and each sheet was imagewise exposed to light, for 60 seconds, from a 3 KW metal halide lamp at a distance of 1 m through an original film.

To a developing bath of a commercially available automatic developing machine PS-900D provided with a dip type developing bath (Fuji Photo Film Co., Ltd.), there was added a developer which was an aqueous solution of potassium silicate having a molar ratio, $[SiO_2]/[M_2O]$, of 1.2 and an $SiO_2$ content of 1.5% by weight containing 0.04% by weight of an amphoteric surfactant: N-alkyl-N,N-dihydroxyethyl betaine, followed by separately processing each kind of the imagewise exposed PS plates over one month in a rate of 100 sheets per day, while maintaining a predetermined activity level of the developer by detecting the reduction in the activity of the developer due to the processing of the PS plate and the absorption of carbon dioxide in air by a built-in conductance sensor of PS-900D and supplementing a replenisher which was an aqueous solution of potassium silicate having a molar ratio, $[SiO_2]/[M_2O]$, of 0.8 and an $SiO_2$ content of 1.9% by weight containing 0.04% by weight of an amphoteric surfactant: N-alkyl-N,N-dihydroxyethyl betaine according to a feedback control system with a computer. The activity was checked by exposing the PS plate through Step Tablet (15 steps each having an optical density difference of 0.15) while stepwise changing the quantity of light, developing the plate, reading the step number of the image remaining on the plate depending on the quantity of exposed light and comparing the step number with that observed at the starting of the processing. After one month, the developer was removed from the developing bath to examine the presence or absence of insolubles at the bottom of the bath. The results are listed in Table 1. As a result, any insoluble matter was not observed in the baths for processing PS plates a,b and c on which back coat layers had been applied or which had been treated with silicates. On the other hand, the bath for processing the PS plate d free of the foregoing treatment suffered from various troubles such as formation of insolubles in the developing bath, clogging of the spray nozzle and the filter and adhesion of white deposits to the surface of rollers.

To store the developed PS plate, a developing ink PI-2 (an emulsion type one available from Fuji Photo Film Co., Ltd.) was then applied onto the plate surface with a sponge. After washing with water to remove the ink on the non-image area, a gumming solution obtained by diluting Protective Gum GU-7 (available from Fuji Photo Film Co., Ltd.) 2 times with water was coated on the plate and dried. The resulting printing plates were stored while putting them in layers and it was found that the ink adhered to the back face of PS plate b was transferred to the surface thereof and this resulted in severe deterioration of the plate-examining properties of the plate.

TABLE 1

| | Ex. | Comp. Ex. | | |
|---|---|---|---|---|
| | 1 | 1 | 2 | 3 |
| | PS plate | | | |
| | a | b | c | d |
| Adhesion and Peeling Off of Light-Sensitive Layer | none | none | observed | slightly observed |
| Insolubles in Developing Bath | none | none | none | observed |
| Ink Adhesion to Back Face | none | observed | none | none |
| Contact Angle of Back Face Water Droplet in Air | | | | |
| Before Developing | 70° | 75° | 11° | 40° |
| After Developing | 12° | 73° | 8° | 10° |

Example 2 and Comparative Examples 4 and 5

An aluminum plate having a thickness of 0.24 mm was surface-grained with a nylon brush and an aqueous suspension of 400 mesh pumice stone and then sufficiently washed with water. After etching the plate by immersing in a 10% sodium hydroxide solution at 70° C. for 20 seconds and washing with running water, the plate was neutralized and washed with a 20% $NHO_3$ solution and then washed with water. Then the plate was electrolytically surface-roughened in a 0.7% aqueous solution of nitric acid at an anodic voltage, $V_A$, of 12.7 V such that the quantity of electricity at the anode time was 400 coulomb/dm$^2$ using a sinusoidal alternating wave current. The plate was treated in a 10% aqueous sodium hydroxide solution in such a manner that 0.9 g/m$^2$ of aluminum was dissolved out from the plate surface. After water-washing, the plate was neutralized and washed with a 20% $NHO_3$ solution and then washed with water to desmut. Then it was anodized in a 18% aqueous solution of sulfuric acid, while a cathode was positioned face to face with the grained surface, so that the thickness of the resulting anodized layer was 3 g/m$^2$ followed by water-washing and drying to give a substrate E. At this stage, the anodized layer formed on the back face of the substrate E had a thickness of 0.3 to 0.6 g/m$^2$.

Then the following sol-gel reaction solution was applied onto the back face of the substrate E thus treated with a bar coater and dried at 100° C. for one minute to give a substrate F having a back coat layer of 60 mg/m$^2$ (weighed after drying).

Sol-Gel Reaction Solution

| Component | Amount (parts by weight) |
|---|---|
| tetraethylsilicate | 50 |
| water | 86.4 |
| methanol | 10.8 |
| phosphoric acid (85%) | 0.08 |

The foregoing components were mixed and stirred and about 35 minutes thereafter, the mixture generated heat. After reacting them for 40 minutes with stirring, 700 parts by weight of methanol was added to give a back coat-coating solution.

Then the following light-sensitive solution was applied onto the surface of Substrate E or F and then dried to give a light-sensitive layer in an amount of 2.5 g/m$^2$ (weighed after drying).

Light-sensitive Solution

| Component | Amount (parts by weight) |
|---|---|
| ester of 1,2-diazonaphthoquinone-5-sulfonyl chloride with pyrogallol/acetone resin (compound described in Example 1 of U.S. Pat. No. 3,635,709) | 76 |
| cresol/formaldehyde novolak resin | 190 |
| phthalic anhydride | 20 |
| 4-[p-N-(p-hydroxybenzoyl)aminophenyl]-2,6-bis (trichloromethyl)-s-triazine | 2 |
| Victoria Pure Blue BOH (available from Hodogaya Chemical Co., Ltd.) | 3 |
| Megafac F-177 (a fluorine atom-containing surfactant available from Dainippon Ink and Chemicals, Inc.) | 0.6 |
| methyl ethyl ketone | 1500 |
| propylene glycol monomethyl ether | 1500 |

A mat layer was formed on each light-sensitive layer thus formed on Substrate E or F in the following manner to give each corresponding PS plate e or f.

There was prepared, as the mat layer-forming resin solution, a 14% aqueous solution of a methyl methacrylate/ethyl acrylate/2-acrylamido-2-methylpropanesulfonic acid copolymer (charge weight ratio 50:30:20), then the solution was applied onto the light-sensitive layer using a rotary atomization-electrostatic coating machine under conditions of an atomization head-revolution number of 25,000 rpm, a resin solution-feed rate of 40 ml/min, a voltage applied to the atomization head of −90 KV, an ambient temperature during coating of 25° C. and a relative humidity of 50%. The coated surface was swollen by spraying steam on the surface 2.5 seconds after the application of the resin solution and dried by blowing, for 5 seconds, hot air having a temperature of 60° C. and a humidity of 10% on the surface 3 seconds after the swelling. The mat layer formed comprised projections having an average height of about 5 μm and an average diameter of about 25 to 40 μm and the coated amount thereof was found to be 120 mg/m$^2$.

These PS plates e and f thus prepared each was cut into a large number of sheets having a size of 1,003 mm× 800 mm and each sheet was imagewise exposed to light, for 60 seconds, from a 3 KW metal halide lamp at a distance of 1 m through an original film.

To a developing bath of a commercially available automatic developing machine PS-900D provided with a dip type developing bath (Fuji Photo Film Co., Ltd.), there was added a developer which was an aqueous solution of potassium silicate having the composition listed in the following Table 2 containing 0.04% by weight of an amphoteric surfactant: N-alkyl-N,N-dihydroxyethyl betaine, followed by separately subjecting each kind of the imagewise exposed PS plates to a running treatment over one month in a rate of 100 sheets per day, while maintaining a predetermined activity level of the developer by detecting the reduction in the activity of the developer due to the processing of the PS plate and the absorption of carbon dioxide in air by a built-in conductance sensor of PS-900D and supplementing a replenisher listed in Table 2 according to a feedback control system with a computer. The activity of the developer was checked in the same manner used in Example 1.

TABLE 2

| | Comp. Ex. | | Ex. |
|---|---|---|---|
| | 4 | 5 | 2 |
| | PS plate | | |
| | e | e | f |
| Developer Composition | | | |
| Ratio: $[SiO_2]/[K_2O]$ | 1.2 | 1.2 | 1.2 |
| $SiO_2$ Content (wt %) | 1.5 | 1.5 | 1.5 |
| Replenisher Composition | | | |
| Ratio: $[SiO_2]/[K_2O]$ | 1.2 | 0.72 | 0.72 |
| $SiO_2$ content (wt %) | 3.1 | 1.90 | 1.90 |
| Average Amount of Replenisher Throughout Running Treatment | 83 cc/m$^2$ | 42 cc/m$^2$ | 42 cc/m$^2$ |
| Change in Sensitivity Throughout Running Treatment | ±0.5 step | ±2.5 step | ±0.5 step |
| Formation of Insolubles | slight | great, clogging of spray nozzle | none |

As seen from the compositions of replenishers used and the results obtained through the running treatments listed in Table 2, the amount of replenisher was reduced to about ½ time, any insoluble matter was not formed and stable processing was ensured in the processing of the PS plate of the invention having a back coat layer. On the contrary, in Comparative Example 4, insolubles were only slightly formed, but a large amount of replenisher was required, this led to an increase in the operating cost and Comparative Example 4 required a post-treatment of a large quantity of waste liquor. The amount of the replenisher could be reduced by elevating the activity of the replenisher as in Comparative Example 5, but Comparative Example 5 suffered from various troubles such as contamination of the resulting printing plate with insolubles formed, clogging of spray nozzles and filters and adhesion of white deposits to the surface of rollers and any stable sensitivity was not ensured.

Example 3

The surface (one side) of an aluminum plate having a thickness of 0.2 mm was grained with a nylon brush and an aqueous suspension of 400 mesh pumice stone and then sufficiently washed with water. After etching the plate by immersing in a 10% sodium hydroxide solution at 70° C. for 60 seconds and washing with running water, the plate was electrolytically surface-roughened in a 1% aqueous solution of nitric acid at an anodic voltage, $V_A$, of 12.7 V such that the quantity of electricity at the anode time was 160 coulomb/dm$^2$ using a sinusoidal alternating wave current. The plate was desmutted by immersing it in a 30% aqueous sulfuric acid solution at 55° C. for 2 minutes and anodized in a 20% aqueous solution of sulfuric acid at a current density of 2 A/dm$^2$ so that the thickness of the anodized layer formed on the electrolytically roughened surface was 2.7 g/m$^2$. At this stage, the anodized layer formed on the back face of the plate had a thickness of 0.2 to 0.5 g/m$^2$. The plate was then hydrophilized by immersing it in a 2% aqueous solution of sodium silicate having a molar ratio, $[SiO_2]/[Na_2O]$, of 3.0 at 70° C.

Then a sol-gel reaction solution was applied onto the back face of the substrate thus treated in the same manner used in Example 2 to form a back coat layer.

Then the following light-sensitive solution was applied onto the surface of the substrate to give a light-sensitive layer in an amount of 1.7 g/m$^2$ (weighed after drying).

Light-sensitive Solution

| Component | Amount (parts by weight) |
|---|---|
| hexafluorophosphate of condensate of p-diazodiphenyl-amine with paraformaldehyde | 0.12 |
| 2-hydroxyethyl methacrylate copolymer (a product prepared by the method disclosed in Example 1 of U.S. Pat. No. 4,123,276) | 2.0 |
| Victoria Pure Blue BOH (available from Hodogaya Chemical Co., Ltd.) | 0.03 |
| Megafac F-177 (a fluorine atom-containing surfactant available from Dainippon Ink and Chemicals, Inc.) | 0.006 |
| 2-methoxyethanol | 15 |
| methanol | 10 |
| ethylene chloride | 5 |

A mat layer was formed on the light-sensitive layer thus formed by spraying a mat layer-forming resin solution in the following manner.

There was prepared, as the mat layer-forming resin solution, a 14% aqueous solution of a methyl methacrylate/ethyl acrylate/2-acrylamido-2-methylpropanesulfonic acid copolymer (charge weight ratio 50:30:20), then the solution was applied onto the light-sensitive layer using a rotary atomization-electrostatic coating machine under conditions of an atomization head-revolution number of 25,000 rpm, a resin solution-feed rate of 40 ml/min, a voltage applied to the atomization head of −90 KV, an ambient temperature during coating of 25° C. and a relative humidity of 50%. The coated surface was swollen by spraying steam on the surface 2.5 seconds after the application of the resin solution and dried by blowing, for 5 seconds, hot air having a temperature of 60° C. and a humidity of 10% on the surface 3 seconds after the swelling. The mat layer formed comprised projections having an average height of about 5 μm and an average diameter of about 25 μm and the coated amount thereof was found to be 130 mg/m$^2$.

The negative-working PS plates thus prepared were stored in the form suitable for bulk transportation in the same manner used in Example 1 to determine whether they were adhered to one another, but any trouble was not observed.

Example 4

The same procedures used in Example 3 were repeated to give an aluminum plate having a grained surface and a back coat layer on the back face. The following light-sensitive solution was prepared and applied onto the grained surface of the aluminum substrate in an amount of 1.5 g/m$^2$ (weighed after drying) and dried. Then a mat layer was applied onto the light-sensitive layer in the same manner used in Example 3 to give a negative-working PS plate having a back coat layer on the back face.

| Light-Sensitive Solution | |
|---|---|
| Component | Amount (parts by weight) |
| methyl methacrylate/N-[6-(methacryloyloxy) hexyl]-2,3-dimethylmaleimide/methacrylic acid (molar ratio 10/60/30) copolymer (Mw = 3.5 × 10$^4$ (GPC); Tg = about 40° C. (DSC)) | 5 |
| 3-ethoxycarbonyl-7-methyl-thioxanthone | 0.30 |
| dodecylbenzenesulfonate of co-condensate of 4-diazo-diphenylamine, phenoxyacetic acid with formaldehyde propylene glycol monomethyl ether | 0.20<br>50 |
| methyl ethyl ketone | 50 |
| Megafac F-177 (a fluorine atom-containing surfactant available from Dainippon Ink and Chemicals, Inc.) | 0.03 |
| Victoria Pure Blue BOH (available from Hodogaya Chemical Co., Ltd.) | 0.10 |

The negative-working PS plate thus prepared was subjected to contact exposure through a negative film. The exposure was performed by irradiating with light from a 2 KW very high pressure mercury lamp for 60 seconds. Then the imagewise exposed PS plate was developed at 25° C. for 30 seconds with an aqueous solution of potassium silicate having a molar ratio, $[SiO_2]/[K_2O]$, of 0.72, which was used as the replenisher in Example 2. After water-washing, a gumming solution was applied and the plate was fitted to a KORD printing press to perform printing. As a result, 50,000 copies free of any contamination on the non-image area were obtained.

Many identical negative-working PS plates were prepared and allowed to stand under the bulk storage conditions to determine whether they were adhered to one another or not in the same manner used in Example 1, but any adhesion was not observed. Separately, the same procedures used above were repeated except that any back coat layer was formed to give negative-working PS plates and they were evaluated in the same manner. These comparative PS plates were adhered to one another when stored under the bulk storage conditions.

Example 5

The same procedures used in Example 1 were repeated to give substrate D. The following sol-gel reaction solution diluted with the following dilution solution was applied onto the back face of the substrate D with a bar coater and dried at 100° C. for one minute to give a back coat layer in an amount of 60 mg/m$^2$ (weighed after drying).

| Sol-Gel Reaction Solution | |
|---|---|
| Component | Amount (part by weight) |
| tetraethylsilicate | 50 |
| water | 86.4 |
| methanol | 10.8 |
| phosphoric acid (85%) | 0.08 |

The foregoing components were mixed and stirred and about 35 minutes thereafter, the mixture generated heat. After reacting them for 40 minutes with stirring, the following dilution solution was added to give a back coat-coating solution.

| Dilution Solution | |
|---|---|
| Component | Amount (parts by weight) |
| condensed pyrogallol/acetone resin | 3.5 |
| dibutyl maleate | 5.0 |
| Megafac F-177 (a fluorine atom-containing surfactant available from Dainippon Ink and Chemicals, Inc.) | 0.8 |
| methanol | 800 |
| propylene glycol monomethyl ether | 270 |

Then a light-sensitive layer and a mat layer were, in order, applied onto the surface of the substrate in the same manner used in Example 1 to give a positive-working PS plate.

The back coat layer of the PS plate thus formed had sufficient flexibility and never caused cracking. The plate was evaluated in the same manner used in Example 1 and was found to have quality identical to that of the PS plate a.

Example 6

The same procedures used in Example 1 were repeated except that a back coat layer was formed by applying the following sol-gel reaction solution onto the back face of the substrate with a bar coater in an amount of 60 mg/m$^2$ (weighed after drying) to thus give a PS plate identical to that prepared in Example 1.

| Sol-Gel Reaction Solution | |
|---|---|
| Component | Amount (parts by weight) |
| tetraethylsilicate | 45 |
| γ-glycidoxypropyltrimethoxysilane | 5.0 |
| water | 86.4 |
| methanol | 10.8 |
| phosphoric acid (85%) | 0.08 |

The foregoing components were mixed and stirred and about 35 minutes thereafter, the mixture generated heat. It was reacted for 40 minutes with stirring and then 700 parts by weight of methanol was added to the reaction mixture to give a back coat-forming solution.

The back coat layer of the PS plate thus prepared had good adhesion to the substrate and the PS plate exhibited quality identical to that observed for the PS plate a of Example 1.

Example 7

The same procedures used in Example 1 were repeated except that a back coat layer was formed by applying the following sol-gel reaction solution onto the back face of the substrate with a bar coater in an amount of 60 mg/m$^2$ (weighed after drying) to thus give a PS plate identical to that prepared in Example 1.

| Sol-Gel Reaction Solution | |
|---|---|
| Component | Amount (parts by weight) |
| tetra-n-butylsilicate | 50 |
| water | 21.6 |
| methanol | 10.8 |
| nitric acid | 0.05 |

The foregoing components were mixed and stirred and about 15 minutes thereafter, the mixture generated heat. It was reacted for 20 minutes with stirring and then 700 parts by weight of methanol was added to the reaction mixture to give a back coat-forming solution.

The PS plate was evaluated in the same manner used in Example 1 and was found to show quality identical to that observed for the PS plate a of Example 1.

Example 8

The same procedures used in Example 1 were repeated to give a substrate D. The following sol-gel reaction solution diluted with the following dilution solution was applied onto the back face of the substrate D with a bar coater and dried at 100° C. for one minute to give a back coat layer in an amount of 60 mg/m$^2$ (weighed after drying).

| Sol-Gel Reaction Solution | |
|---|---|
| Component | Amount (parts by weight) |
| tetraethylsilicate | 50 |
| water | 86.4 |
| methanol | 10.8 |
| phosphoric acid (85%) | 0.08 |

The foregoing components were mixed and reacted in a reactor maintained at 25° C. for 50 minutes with stirring, followed by mixing with the following dilution solution to give a back coat-coating solution.

| Dilution Solution | |
|---|---|
| Component | Amount (parts by weight) |
| condensed pyrogallol/acetone resin | 3.5 |
| polypropylene glycol monoethyl ether (average molecular weight: 270) | 5.0 |
| Megafac F-177 (a fluorine atom-containing surfactant available from Dainippon Ink and Chemicals, Inc.) | 0.8 |
| methanol | 800 |
| propylene glycol monomethyl ether | 270 |

Then a light-sensitive layer and a mat layer were, in order, applied onto the surface of the substrate in the same manner used in Example 1 to give a positive-working PS plate.

The back coat layer of the PS plate thus formed had sufficient flexibility and never caused cracking. The plate was evaluated in the same manner used in Example 1 and was found to have quality identical to that of the PS plate a.

Example 9

The same procedures used in Example 1 were repeated except that a back coat layer was formed by applying the following $SiO_2$-$TiO_2$ type sol-gel reaction solution onto the back face of the substrate with a bar coater in an amount of 60 mg/m$^2$ (weighed after drying) to thus give a PS plate identical to that prepared in Example 1.

| Sol-Gel Reaction Solution | |
|---|---|
| Component | Amount (parts by weight) |
| tetraethylsilicate | 45 |
| tetraethyl titanate | 5 |
| water | 21.6 |
| methanol | 10.8 |
| nitric acid | 0.05 |

The foregoing components were mixed and stirred and about 5 minutes thereafter, the mixture generated heat. It was reacted for 15 minutes and then 700 parts by weight of methanol was added to the reaction mixture to give a back coat-forming solution.

The PS plate was evaluated in the same manner used in Example 1 and was found to show quality identical to that observed for the PS plate a of Example 1.

Example 10

The same procedures used in Example 1 were repeated except that a back coat layer was formed by applying the following sol-gel reaction solution onto the back face of the substrate with a bar coater in an amount of 60 mg/m$^2$ (weighed after drying) to thus give a PS plate identical to that prepared in Example 1.

| Sol-Gel Reaction Solution | |
|---|---|
| Component | Amount (parts by weight) |
| tetraethylsilicate | 50 |
| water | 21.6 |
| methanol | 10.8 |
| malic acid | 0.25 |

The foregoing components were mixed and stirred and about 10 minutes thereafter, the mixture generated heat. It was reacted for 15 minutes and then 700 parts by weight of methanol was added to the reaction mixture to give a back coat-forming solution.

The resulting back coat-forming solution scattered around the bar coater and evaporated to dryness could easily be dissolved in and removed by an organic solvent such as methanol. The PS plate was evaluated in the same manner used in Example 1 and was found to show quality identical to that observed for the PS plate a of Example 1.

Example 11

The same procedures used in Example 1 were repeated to give a substrate D. The following sol-gel reaction solution diluted with the following dilution solution was applied onto the back face of the substrate D with a bar coater and dried at 100° C. for one minute to give a back coat layer in an amount of 110 mg/m$^2$ (weighed after drying).

| Sol-Gel Reaction Solution | |
|---|---|
| Component | Amount (parts by weight) |
| tetraethylsilicate | 50 |
| water | 86.4 |
| methanol | 10.8 |
| phosphoric acid (85%) | 0.08 |

The foregoing components were mixed and stirred and about 35 minutes thereafter, the mixture generated heat. The mixture was reacted for 40 minutes with stirring, followed by mixing with the following dilution solution to give a back coat-coating solution.

| Dilution Solution | |
|---|---|
| Component | Amount (parts by weight) |
| ester of 1,2-diazonaphthoquinone-5-sulfonyl chloride and pyrogallol/acetone resin (compound disclosed in Example 1 of U.S. Pat. No. 3,635,709) | 3.5 |
| dibutyl maleate | 5.0 |
| Megafac F-177 (a fluorine atom-containing surfactant available from Dainippon Ink and Chemicals, Inc.) | 0.8 |
| methanol | 600 |
| propylene glycol monomethyl ether | 270 |

Then a light-sensitive layer and a mat layer were, in order, applied onto the surface of the substrate in the same manner used in Example 1 to give a positive-working PS plate.

The back coat layer of the PS plate thus formed had sufficient flexibility, never caused cracking and was excellent in alkali resistance (developability). The plate was evaluated in the same manner used in Example 1 and was found to have quality identical to that of the PS plate a.

Example 12

The same procedures used in Example 1 were repeated to give a substrate D. The following sol-gel reaction solution diluted with the following dilution solution was applied onto the back face of the substrate D with a bar coater and dried at 100° C. for one minute to give a back coat layer in an amount of 90 mg/m$^2$ (weighed after drying).

| Sol-Gel Reaction Solution | |
|---|---|
| Component | Amount (parts by weight) |
| tetraethylsilicate | 50 |
| water | 86.4 |
| methanol | 10.8 |
| phosphoric acid (85%) | 0.08 |

The foregoing components were mixed and stirred and about 35 minutes thereafter, the mixture generated heat. The mixture was reacted for 40 minutes with stirring, followed by mixing with the following dilution solution to give a back coat-coating solution.

| Dilution Solution | |
|---|---|
| Component | Amount (parts by weight) |
| condensed pyrogallol/acetone resin | 3.5 |
| dibutyl maleate | 5.0 |
| Malachite Green · oxalate | 0.02 |
| Megafac F-177 (a fluorine atom-containing surfactant available from Dainippon Ink and Chemicals, Inc.) | 1.0 |
| methanol | 800 |
| propylene glycol monomethyl ether | 270 |

Then a light-sensitive layer and a mat layer were, in order, applied onto the surface of the substrate in the same manner used in Example 1 to give a positive-working PS plate.

The back face of the PS plate thus prepared was colored and the plate could easily be distinguished from other plate-making materials. The plate was evaluated in the same manner used in Example 1 and was found to have quality identical to that of the PS plate a.

Example 13

An aluminum plate having a thickness of 0.24 mm was surface-grained with a nylon brush and an aqueous suspension of 400 mesh pumice stone and then sufficiently washed with water. After etching the plate by immersing in a 10% sodium hydroxide solution at 70° C. for 60 seconds and washing with running water, the plate was neutralized and washed with a 20% $HNO_3$ solution and then washed with water. Then the plate was electrolytically surface-roughened in a 1% aqueous solution of nitric acid at an anodic voltage, $V_A$, of 12.7 V such that the quantity of electricity at the anode time was 160 coulomb/dm$^2$ using a sinusoidal alternating wave current. At this stage, the surface roughness thereof was determined to be 0.6μ (expressed in terms of the Ra unit). Then it was desmutted by immersing in a 30% aqueous solution of sulfuric acid at 55° C. for 2 minutes and anodized in a 20% aqueous solution of sulfuric acid at a current density of 4 A/dm$^2$, while a cathode was positioned face to face with the grained surface, so that the thickness of the resulting anodized layer was 2.5 g/m$^2$. At this stage, the anodized layer formed on the back face of the plate had a thickness of about 0.2 g/m$^2$ at the central portion and about 0.5 g/m$^2$ at the periphery.

Then the following sol-gel reaction solution was applied onto the back face of the substrate thus treated with a bar coater and dried at 80° C. for one minute to give a substrate having a back coat layer of 70 mg/m$^2$ (weighed after drying).

| Sol-Gel Reaction Solution | |
|---|---|
| Component | Amount (parts by weight) |
| tetraethylsilicate | 50 |
| water | 20 |
| methanol | 15 |
| phosphoric acid | 0.05 |

The foregoing components were mixed and stirred and about 5 minutes thereafter, the mixture generated heat. After reacting them for 60 minutes, the following solution was added to give a back coat-coating solution.

| Component | Amount (parts by weight) |
|---|---|
| condensed pyrogallol/formaldehyde resin (M.W. 2000) | 4 |
| dimethyl phthalate | 5 |
| fluorine atom-containing surfactant (N-butylperfluorooctanesulfonamidoethyl acrylate/polyoxyethylene acrylate copolymer (M.W. 20,000)) | 0.7 |
| methanol silica sol (available from Nissan Chemical Industries, Ltd.; 30% methanol) | 50 |
| methanol | 800 |

Then the following light-sensitive solution was applied onto the surface of the substrate and then dried to give a light-sensitive layer in an amount of 2.5 g/m$^2$ (weighed after drying).

Light-sensitive Solution

| Component | Amount (parts by weight) |
|---|---|
| ester of 1,2-diazonaphthoquinone-5-sulfonyl chloride with pyrogallol/acetone resin (compound described in Example 1 of U.S. Pat. No. 3,635,709). | 45 |
| cresol/formaldehyde novolak resin | 110 |
| 2-(p-methoxyphenyl)-4,6-bis(trichloromethyl)-s-triazine | 2 |
| Oil Blue #603 (available from Orient Chemical Industry Co., Ltd.) | 1 |
| Megafac F-177 (a fluorine atom-containing surfactant available from Dainippon Ink and Chemicals, Inc.) | 0.4 |
| methyl ethyl ketone | 100 |
| propylene glycol monomethyl ether | 100 |

The PS plate thus prepared was cut into sheets having a size of 1030 mm× 800 mm to prepare 50 sheets which were then put in layers, sandwiched between two cardboards having a thickness of about 0.5 mm, the four corners of the assembly was fastened with an adhesive tape and then the assembly was packed in an aluminum kraft paper. The resulting package was further packed in a corrugated board box which was fastened with an adhesive tape and subjected to a test for transportation by a truck. The PS plates were examined for the presence of scratch marks formed during the transportation and the results thus obtained were listed in the following Table 3. Then the PS plate was cut into a large number of sheets having a size of 1,030 mm×800 mm and each sheet was imagewise exposed to light, for 60 seconds, from a 3 KW metal halide lamp at a distance of 1 m through an original film.

To a developing bath of a commercially available automatic developing machine PS-900D provided with a dip type developing bath (Fuji Photo Film Co., Ltd.), there was added a developer which was an aqueous solution of potassium silicate having a molar ratio, $[SiO_2]/[M_2O]$, of 1.2 and an $SiO_2$ content of 1.5% by weight containing 0.04% by weight of an amphoteric surfactant: N-alkyl-N,N-dihydroxyethyl betaine, followed by processing the imagewise exposed PS plate over one month in a rate of 100 sheets per day, while maintaining a predetermined activity level of the developer by detecting the reduction in the activity of the developer due to the processing of the PS plate and the absorption of carbon dioxide in air by a built-in conductance sensor of PS-900D and supplementing a replenisher which was an aqueous solution of potassium silicate having a molar ratio, $[SiO_2]/[M_2O]$, of 0.8 and an $SiO_2$ content of 1.9% by weight containing 0.04% by weight of an amphoteric surfactant: N-alkyl-N,N-dihydroxyethyl betaine according to a feedback control system with a computer. The activity was checked by exposing the PS plate through Step Tablet (15 steps each having an optical density difference of 0.15) while stepwise changing the quantity of light, developing the plate, reading the step number of the image remaining on the plate depending on the quantity of exposed light and comparing the step number with that observed at the starting of the processing. After one month, the developer was removed from the developing bath to examine the presence or absence of insolubles at the bottom of the bath. The results are listed in Table 3. As a result, any insoluble matter was not observed in the bath for processing the PS plate on which a back coat layer had been applied.

To store the developed PS plate, a developing ink PI-2 (an emulsion type one available from Fuji Photo Film Co., Ltd.) was then applied onto the plate surface with a sponge. After washing with water to remove the ink on the non-image area, a gumming solution obtained by diluting Protective Gum GU-7 (available from Fuji Photo Film Co., Ltd.) 2 times with water was coated on the plate and dried. The resulting printing plates were stored while putting them in layers and it was found that any adhesion of the ink to the back face was not observed. Furthermore, the back coat-forming solution was intentionally dropped on the burnished surface of a stainless steel material 316 and solidified, as a simulation test for confirming the production aptitude. After 3 days, it was determined whether the solidified droplet could be removed by rubbing the surface in the presence of a mixed organic solvent: methanol/methyl ethyl ketone (1:1). In addition, a simulation test for confirming the production aptitude was likewise performed. The test comprised dropping the back coat-forming solution on the mirror finished surface of a stainless steel material 304 and after one week, examining whether the droplet was peeled off in a scaly form and liable to be scattered in the form of fine powder or not. Moreover, coating operations with a bar coater were repeated 20 times and the condition of the coated surface was examined as a test for confirming the production aptitude. In addition, the solution was dropped on the edge portion of the substrate to determine whether the solution passed around behind the back face thereof. The results of these tests are summarized in Table 3. The PS plate did not suffer from problems concerning the production, permitted a stable bulk processing over a long time and was not easily damaged even when an interleaf was not used during storage. Any developing ink or the like was not adhered to the back face of the PS plate.

TABLE 3

| | PS plate of the present invention |
|---|---|
| Quality | |
| Formation of Insolubles in Developing Bath | not observed |
| Scratch Marks on Light-Sensitive Layer During Transportation | not observed |
| Adhesion of PI-2 Ink to Back Face of PS Plate (under severe conditions *) | not observed |
| Production aptitude | |
| Ability of Solid Formed from Back Coat-Forming Solution to be Removed with Organic Solvent | good |
| Scaly Peeling Off of the Solid | not observed |

TABLE 3-continued

| | PS plate of the present invention |
|---|---|
| Uniformity of Coated Surface | good |
| Ability of the Solution to Pass Around Behind the Back Face | not observed |

*: Presence or absence of adhered ink observed when PI-2 ink whose emulsion condition was broken (which is, in itself, a stable emulsion) was applied onto the back face. Under such conditions, the ink is easily adhered to the back face as compared with the normal ink.

Example 14

An aluminum plate having a thickness of 0.24 mm was surface-grained with a nylon brush and an aqueous suspension of 400 mesh pumice stone and then sufficiently washed with water. After etching the plate by immersing in a 10% sodium hydroxide solution at 70° C. for 20 seconds and washing with running water, the plate was neutralized and washed with a 20% $HNO_3$ solution and then washed with water. Then the plate was electrolytically surface-roughened in a 0.7% aqueous solution of nitric acid at an anodic voltage, $V_A$, of 12.7 V such that the quantity of electricity at the anode time was 400 coulomb/dm$^2$ using a sinusoidal alternating wave current. The plate was treated in a 10% aqueous sodium hydroxide solution in such a manner that 0.9 g/m$^2$ of aluminum was dissolved out from the plate surface. After water-washing, the plate was neutralized and washed with a 20% $HNO_3$ solution and then washed with water to desmut. Then it was anodized in a 18% aqueous solution of sulfuric acid, while a cathode was positioned face to face with the grained surface, so that the thickness of the resulting anodized layer was 2 g/m$^2$ followed by water-washing and drying to give a substrate. At this stage, the anodized layer formed on the back face of the plate had a thickness of 0.2 to 0.4 g/m$^2$.

Then the following sol-gel reaction solution was applied onto the back face of the substrate thus treated with a bar coater and dried at 100° C. for 30 seconds to give a substrate having a back coat layer of 120 mg/m$^2$ (weighed after drying).

Sol-Gel Reaction Solution

| Component | Amount (parts by weight) |
|---|---|
| tetraethylsilicate | 50 |
| water | 90 |
| methanol | 10 |
| phosphoric acid | 0.1 |

The foregoing components were mixed and stirred and about 30 minutes thereafter, the mixture generated heat. After reacting them for 60 minutes with stirring, the following solution was added to give a back coat-coating solution.

| Component | Amount (parts by weight) |
|---|---|
| condensed resorcinol/formaldehyde resin | 5 |
| dibutyl maleate | 5 |
| Megafac F-176 (available from Dainippon Ink and Chemicals, Inc.) | 0.5 |

-continued

| Component | Amount (parts by weight) |
|---|---|
| Snowtex O (colloidal silica available from Nissan Chemical Industries, Ltd.; a 20% aqueous solution) | 80 |
| methanol | 900 |

Then the following light-sensitive solution was applied onto the surface of the substrate and then dried to give a light-sensitive layer in an amount of 2.5 g/m$^2$ (weighed after drying).

Light-sensitive Solution

| Component | Amount (parts by weight) |
|---|---|
| ester of 1,2-diazonaphthoquinone-5-sulfonyl chloride with pyrogallol/acetone resin (compound described in Example 1 of U.S. Pat. No. 3,635,709) | 76 |
| cresol/formaldehyde novolak resin | 190 |
| phthalic anhydride | 20 |
| 4-[p-N-(p-hydroxybenzoyl)aminophenyl]-2,6-bis (trichloromethyl)-s-triazine | 2 |
| Victoria Pure Blue BOH (available from Hodogaya Chemical Co., Ltd.) | 3 |
| Megafac F-177 (a fluorine atom-containing surfactant available from Dainippon Ink and Chemicals, Inc.) | 0.6 |
| methyl ethyl ketone | 1500 |
| propylene glycol monomethyl ether | 1500 |

The PS plate thus prepared was cut into a large number of sheets having a size of 1,003 mm×800 mm and each sheet was imagewise exposed to light, for 60 seconds, from a 3 KW metal halide lamp at a distance of 1 m through an original film.

To a developing bath of a commercially available automatic developing machine PS-900D provided with a dip type developing bath (Fuji Photo Film Co., Ltd.), there was added a developer which was an aqueous solution of potassium silicate having a molar ratio, $[SiO_2]/[M_2O]$, of 1.1 and an $SiO_2$ content of 1.3% by weight containing 0.04% by weight of an amphoteric surfactant: N-alkyl-N,N-dihydroxyethyl betaine, followed by subjecting the imagewise exposed PS plate to a running treatment over one month in a rate of 100 sheets per day, while maintaining a predetermined activity level of the developer by detecting the reduction in the activity of the developer due to the processing of the PS plate and the absorption of carbon dioxide in air by a built-in conductance sensor of PS-900D and supplementing a replenisher having a molar ratio, $[SiO_2]/[M_2O]$, of 0.6 and an $SiO_2$ content of 1.80% by weight according to a feedback control system with a computer. The activity of the developer was checked in the same manner used in Example 13.

Tests for the presence of scratch marks on the light-sensitive layer during transportation, for the adhesion of ink on the back face of the lithographic printing plate through application of PI-2 ink to the ink-receiving portion, for the ability of the solid formed from the back coat-forming solution to be removed by an organic solvent, for the presence of scaly peeling off of the solid, for the condition of the coated surface and for the ability of the back coat-forming solution to pass around behind the back face were performed in the same manner used in Example 13. The results thus obtained are listed in the following Table 4.

TABLE 4

| | PS plate of the present invention |
|---|---|
| Processing Properties | |
| Average Amount of Replenisher During Running | 35 cc/m$^2$ |
| Sensitivity Change During Running | ±0.5 step |
| Formation of Insolubles in Developing Bath | not observed |
| Quality | |
| Scratch Marks on Light-Sensitive Layer During Transportation | not observed |
| Adhesion of PI-2 Ink to Back Face of PS Plate (under severe conditions, see foot note of Table 3) | not observed |
| Production aptitude | |
| Ability of Solid Formed from Back Coat-Forming Solution to be Removed with Organic Solvent | good |
| Quality of Coated surface | good |
| Scaly Peeling Off of the Solid | not observed |
| Ability of the Solution to Pass Around Behind the Back Face | not observed |

The amount of replenisher was reduced to about ½ times and like the result of Example 1, any insoluble matter was not formed and stable processing was ensured in the processing of the PS plate of the invention having a back coat layer.

Example 15

The surface (one side) of an aluminum plate having a thickness of 0.2 mm was grained with a nylon brush and an aqueous suspension of 400 mesh pumice stone and then sufficiently washed with water. After etching the plate by immersing in a 10% sodium hydroxide solution at 70° C. for 60 seconds and washing with running water, the plate was electrolytically surface-roughened in a 1% aqueous solution of nitric acid at an anodic voltage, $V_A$, of 12.7 V such that the quantity of electricity at the anode time was 160 coulomb/dm$^2$ using a sinusoidal alternating wave current. The plate was desmutted by immersing it in a 30% aqueous sulfuric acid solution at 55° C. for 2 minutes and anodized in a 20% aqueous solution of sulfuric acid at a current density of 2 A/dm$^2$ so that the thickness of the anodized layer formed on the electrolytically roughened surface was 2.7 g/m$^2$. At this stage, the anodized layer formed on the back face of the plate had a thickness of 0.2 to 0.5 g/m$^2$. The plate was then hydrophilized by immersing it in a 2% aqueous solution of sodium silicate having a molar ratio, $[SiO_2]/[Na_2O]$, of 3.0 at 70° C.

Then a sol-gel reaction solution was applied onto the back face of the substrate thus treated in the same manner used in Example 14 to form a back coat layer.

Then the following light-sensitive solution was applied onto the surface of the substrate to give a light-sensitive layer in an amount of 1.7 g/m$^2$ (weighed after drying).

Light-sensitive Solution

| Component | Amount (parts by weight) |
|---|---|
| hexafluorophosphate of condensate of p-diazodiphenyl-amine with paraformaldehyde | 0.12 |
| 2-hydroxyethyl methacrylate copolymer (a product prepared by the method disclosed in Example 1 of U.S. Pat. No. 4,123,276) | 2.0 |
| Victoria Pure Blue BOH (available from Hodogaya Chemical Co., Ltd.) | 0.03 |
| Megafac F-177 (a fluorine atom-containing surfactant available from Dainippon Ink and Chemicals, Inc.) | 0.006 |
| 2-methoxyethanol | 15 |
| methanol | 10 |
| ethylene chloride | 5 |

The resulting negative-working PS plate showing good production aptitude was tested for the formation of scratch marks during bulk transportation in the same manner used in Example 13. As a result, any problem did not arise and any adhesion of PI-2 ink to the back face was not also observed. Moreover, the production of the back coat layer did not suffer from any trouble.

Example 16

The same procedures used in Example 15 were repeated to give an aluminum plate having a grained surface and a back coat layer on the back face. The following light-sensitive solution was prepared and applied onto the grained surface of the aluminum substrate in an amount of 1.5 g/m$^2$ (weighed after drying) and dried to give a negative-working PS plate.

Light-Sensitive Solution

| Component | Amount (parts by weight) |
|---|---|
| methyl methacrylate/N-[6-(methacryloyloxy) hexyl]-2,3-dimethylmaleimide/methacrylic acid (molar ratio 10/60/30) copolymer (Mw = 3.5 × 10$^4$ (GPC); Tg = about 40° C. (DSC)) | 5 |
| 3-ethoxycarbonyl-7-methyl-thioxanthone | 0.30 |
| dodecylbenzenesulfonate of co-condensate of 4-diazo-diphenylamine, phenoxyacetic acid with formaldehyde | 0.20 |
| propylene glycol monomethyl ether | 50 |
| methyl ethyl ketone | 50 |
| Megafac F-177 (a fluorine atom-containing surfactant available from Dainippon Ink and Chemicals, Inc.) | 0.03 |
| Victoria Pure Blue BOH (available from Hodogaya Chemical Co., Ltd.) | 0.10 |

The negative-working PS plate thus prepared was subjected to contact exposure through a negative film. The exposure was performed by irradiating with light from a 2 KW very high pressure mercury lamp for 60 seconds. Then the imagewise exposed PS plate was developed at 25° C. for 30 seconds with an aqueous solution of potassium silicate having a molar ratio, $[SiO_2]/[K_2O]$, of 1.1 used in Example 14. After water-washing, a gumming solution was applied and the plate was fitted to a KORD printing press to perform printing. As a result, 50,000 copies free of any contamination on the non-image area were obtained.

Many identical negative-working PS plates were prepared and subjected to a bulk transportation test in the same manner used in Example 13 and the formation of scratch marks was not observed. Moreover, the adhesion of PI-2 ink to the back face was not observed.

Example 17

The same procedures used in Example 13 were repeated to give a surface-grained and anodized substrate. The following sol-gel reaction solution diluted with the following dilution solution was applied onto the back face of the substrate with a bar coater and dried at 100° C. for one minute to give a back coat layer in an amount of 60 mg/m$^2$ (weighed after drying).

| Sol-Gel Reaction Solution | |
|---|---|
| Component | Amount (parts by weight) |
| tetraethylsilicate | 50 |
| water | 86.4 |
| methanol | 10.8 |
| phosphoric acid (85%) | 0.08 |

The foregoing components were mixed and stirred and about 60 minutes thereafter, the mixture generated heat. After reacting them for 30 minutes with stirring, the following dilution solution was added to give a back coat-coating solution.

| Dilution Solution | |
|---|---|
| Component | Amount (parts by weight) |
| phenol/formaldehyde resin (M.W. 3,000) | 3.5 |
| dibutyl phthalate | 5.0 |
| Megafac F-177 (a fluorine atom-containing surfactant available from Dainippon Ink and Chemicals, Inc.) | 0.5 |
| methanol silica sol (available from Nissan Chemical Industries, Ltd.; 30% methanol) | 50 |
| methanol | 800 |
| propylene glycol monomethyl ether | 270 |

Then a light-sensitive layer was formed on the surface of the substrate in the same manner used in Example 13 to give a positive-working PS plate.

The back coat layer of the PS plate thus formed had sufficient flexibility and never caused cracking. The plate was evaluated in the same manner used in Example 13 and was found to have quality identical to that of the PS plate of Example 13.

Example 18

The same procedures used in Example 13 were repeated to give a substrate identical to that prepared in Example 13. The amount of the anodized layer formed on the surface was 2.5 g/m$^2$ and that of the anodized layer formed on the back face ranged from 0.2 to 0.5 g/m$^2$. The following sol-gel reaction solution diluted with the following dilution solution was applied onto the back face of the substrate with a bar coater and dried at 70° C. for one minute to give a back coat layer in an amount of 60 mg/m$^2$ (weighed after drying).

| Sol-Gel Reaction Solution | |
|---|---|
| Component | Amount (parts by weight) |
| tetraethylsilicate | 50 |
| water | 20 |
| ethanol | 10 |
| nitric acid | 0.04 |

The foregoing components caused an exothermic reaction through mixing and stirring. They were reacted for about 90 minutes and the following dilution solution was added to give a back coat-coating solution.

| Dilution Solution | |
|---|---|
| Component | Amount (parts by weight) |
| methanol silica sol (available from Nissan Chemical Industries, Ltd.; 30% methanol) | 60 |
| ethanol | 800 |

Then a light-sensitive layer identical to that used in Example 13 was formed on the surface of the substrate in an amount of 2.5 g/m$^2$ (weighed after drying) to give a PS plate.

The resulting PS plate was subjected to the same tests for bulk transportation, for the formation of insolubles in the developer (running test over one month) and for the adhesion of PI-2 ink. The results obtained are summarized in the following Table 5.

TABLE 5

| | PS plate of the Present Invention |
|---|---|
| Scratch Marks Formed During Transportation | not observed |
| Insolubles Formed in Developing Bath | not observed |
| Adhesion of PI-2 Ink to Back Face | not observed |

Although the PS plate was slightly inferior in the ability to be removed with an organic solvent, the condition of the coated surface was quite uniform and it did not suffer from the problem concerning the production aptitude.

Example 19

An aluminum plate having a thickness of 0.3 mm was surface-grained with a nylon brush and an aqueous suspension of 400 mesh pumice stone and then sufficiently washed with water. After etching the plate by immersing in a 10% sodium hydroxide solution at 70° C. for 60 seconds and washing with running water, the plate was neutralized and washed with a 20% $HNO_3$ solution and then washed with water. Then the plate was electrolytically surface-roughened in a 1% aqueous solution of nitric acid at an anodic voltage, $V_A$, of 12.7 V such that the quantity of electricity at the anode time was 160 coulomb/dm$^2$ using a sinusoidal alternating wave current. At this stage, the surface roughness thereof was determined to be 0.6μ (expressed in terms of the Ra unit). Then it was desmutted by immersing in a 30% aqueous solution of sulfuric acid at 55° C. for 2 minutes and anodized in a 20% aqueous solution of sulfuric acid at a current density of 4 A/dm$^2$, while a cathode was positioned face to face with the grained surface, so that the thickness of the resulting anodized layer was 2.7 g/m$^2$. At this stage, the anodized layer formed on the back face of the plate had a thickness of about 0.2 g/m$^2$ at the central portion and about 0.5 g/m$^2$ at the periphery.

Then the following sol-gel reaction solution was applied onto the back face of the substrate thus treated with a bar coater and dried at 100° C. for one minute to give a substrate having a back coat layer of 50 mg/m$^2$ (weighed after drying).

Sol-Gel Reaction Solution

| Component | Amount (parts by weight) |
|---|---|
| tetraethylsilicate | 50 |
| water | 20 |
| methanol | 10 |
| phosphoric acid | 0.07 |

The foregoing components were mixed and stirred and about 5 minutes thereafter, the mixture generated heat. After reacting them for 30 minutes, the following solution was added to give a back coat-coating solution.

| Component | Amount (parts by weight) |
|---|---|
| condensed pyrogallol/formaldehyde resin (M.W. 2000) | 4 |
| dimethyl phthalate | 5 |
| methanol | 1000 |

Then the following light-sensitive solution was applied onto the surface of the substrate and then dried to give a light-sensitive layer in an amount of 2.5 g/m$^2$ (weighed after drying).

Light-sensitive Solution

| Component | Amount (parts by weight) |
|---|---|
| ester of 1,2-diazonaphthoquinone-5-sulfonyl chloride with pyrogallol/acetone resin (compound described in Example 1 of U.S. Pat. No. 3,635,709) | 45 |
| cresol/formaldehyde novolak resin | 110 |
| 2-(p-methoxyphenyl)-4,6-bis(trichloromethyl)-s-triazine | 2 |
| Oil Blue #603 (available from Orient Chemical Industry Co., Ltd.) | 1 |
| Megafac F-177 (a fluorine atom-containing surfactant available from Dainippon Ink and Chemicals, Inc.) | 0.4 |
| methyl ethyl ketone | 100 |
| propylene glycol monomethyl ether | 100 |

The PS plate thus prepared was cut into sheets having a size of 1030 mm× 800 mm to prepare 50 sheets which were then put in layers, sandwiched between two cardboards having a thickness of about 0.5 mm, the four corners of the assembly was fastened with an adhesive tape and then the assembly was packed in an aluminum kraft paper. The resulting package was further packed in a corrugated board box which was fastened with an adhesive tape and subjected to a test for transportation by a truck. The PS plates were examined for the presence of scratch marks formed during the transportation and the results thus obtained were listed in the following Table 6. Then the PS plate was cut into a large number of sheets having a size of 1,030 mm×800 mm and each sheet was imagewise exposed to light, for 60 seconds, from a 3 KW metal halide lamp at a distance of 1 m through an original film.

To a developing bath of a commercially available automatic developing machine PS-900D provided with a dip type developing bath (Fuji Photo Film Co., Ltd.), there was added a developer which was an aqueous solution of potassium silicate having a molar ratio, $[SiO_2]/[M_2O]$, of 1.2 and an $SiO_2$ content of 1.5% by weight containing 0.04% by weight of an amphoteric surfactant: N-alkyl-N,N-dihydroxyethyl betaine, followed by processing the imagewise exposed PS plate over one month in a rate of 100 sheets per day, while maintaining a predetermined activity level of the developer by detecting the reduction in the activity of the developer due to the processing of the PS plate and the absorption of carbon dioxide in air by a built-in conductance sensor of PS-900D and supplementing a replenisher which was an aqueous solution of potassium silicate having a molar ratio, $[SiO_2]/[M_2O]$, of 0.8 and an $SiO_2$ content of 1.9% by weight containing 0.04% by weight of an amphoteric surfactant: N-alkyl-N,N-dihydroxyethyl betaine according to a feedback control system with a computer. The activity was checked by exposing the PS plate through Step Tablet (15 steps each having an optical density difference of 0.15) while stepwise changing the quantity of light, developing the plate, reading the step number of the image remaining on the plate depending on the quantity of exposed light and comparing the step number with that observed at the starting of the processing. After one month, the developer was removed from the developing bath to examine the presence or absence of insolubles at the bottom of the bath. The results are listed in Table 6. As a result, any insoluble matter was not observed in the bath for processing the PS plate of the invention having a back coat layer.

To store the developed PS plate, a developing ink PI-2 (an emulsion type one available from Fuji Photo Film Co., Ltd.) was then applied onto the plate surface with a sponge. After washing with water to remove the ink on the non-image area, a gumming solution obtained by diluting Protective Gum GU-7 (available from Fuji Photo Film Co., Ltd.) 2 times with water was coated on the plate and dried. The resulting printing plates were stored while putting them in layers and it was found that any adhesion of ink to the back face was not observed. Furthermore, the back coat-forming solution was intentionally dropped on the burnished surface of a stainless steel material 316 and solidified, as a simulation test for confirming the production aptitude. After 3 days, it was determined whether the solidified droplet could be removed by rubbing the surface in the presence of a mixed organic solvent: methanol/methyl ethyl ketone (1:1). In addition, a simulation test for confirming the production aptitude was likewise performed. The test comprised dropping the back coat-forming solution on the mirror finished surface of a stainless steel material 304 and after one week, examining whether a droplet was peeled off in the scaly form and liable to be scattered in the form of fine powder or not. The results of these tests are summarized in Table 6. The PS plate did not suffer from problems concerning the production, permitted a stable bulk processing over a long time and the light-sensitive layer was not easily damaged even when an interleaf was not used. Any developing ink or the like was not adhered to the back face of the PS plate.

TABLE 6

| | PS plate of the present invention |
|---|---|
| Scratch Marks on Light-Sensitive Layer During Transportation | not observed |
| Formation of Insolubles in Developing Bath | not observed |
| Adhesion of PI-2 Ink to Back Face of PS Plate | not observed |
| Ability of Solid Formed from Back Coat-Forming Solution to be Removed with Organic Solvent | good |
| Scaly Peeling Off of the Solid | not observed |

Example 20

An aluminum plate having a thickness of 0.24 mm was surface-grained with a nylon brush and an aqueous suspension of 400 mesh pumice stone and then sufficiently washed with water. After etching the plate by immersing in a 10% sodium hydroxide solution at 70° C. for 20 seconds and washing with running water, the plate was neutralized and washed with a 20% $HNO_3$ solution and then washed with water. Then the plate was electrolytically surface-roughened in a 0.7% aqueous solution of nitric acid at an anodic voltage, $V_A$, of 12.7 V such that the quantity of electricity at the anode time was 400 coulomb/dm$^2$ using a sinusoidal alternating wave current. The plate was treated in a 10% aqueous sodium hydroxide solution in such a manner that 0.9 g/m$^2$ of aluminum was dissolved out from the plate surface. After water-washing, the plate was neutralized and washed with a 20% $HNO_3$ solution and then washed with water to desmut. Then it was anodized in a 18% aqueous solution of sulfuric acid, while a cathode was positioned face to face with the grained surface, so that the thickness of the resulting anodized layer was 2 g/m$^2$ followed by water-washing and drying to give a substrate. At this stage, the anodized layer formed on the back face of the plate had a thickness of 0.2 to 0.4 g/m$^2$.

Then the following sol-gel reaction solution was applied onto the back face of the substrate thus treated with a bar coater and dried at 100° C. for 30 seconds to give a substrate having a back coat layer of 80 mg/m$^2$ (weighed after drying).

Sol-Gel Reaction Solution

| Component | Amount (parts by weight) |
|---|---|
| tetraethylsilicate | 50 |
| water | 80 |
| methanol | 10 |
| phosphoric acid | 0.1 |

The foregoing components were mixed and stirred and about 45 minutes thereafter, the mixture generated heat. After reacting them for 60 minutes with stirring, the following solution was added to give a back coat-coating solution.

| Component | Amount (parts by weight) |
|---|---|
| condensed resorcinol/formaldehyde resin | 5 |
| dibutyl maleate | 5 |

-continued

| Component | Amount (parts by weight) |
|---|---|
| methanol | 900 |

Then the following light-sensitive solution was prepared and applied onto the surface of the substrate and then dried to give a light-sensitive layer in an amount of 2 g/m$^2$ (weighed after drying).

Light-sensitive Solution

| Component | Amount (parts by weight) |
|---|---|
| ester of 1,2-diazonaphthoquinone-5-sulfonyl chloride with pyrogallol/acetone resin (compound described in Example 1 of U.S. Pat. No. 3,635,709) | 76 |
| cresol/formaldehyde novolak resin | 190 |
| phthalic anhydride | 20 |
| 4-[p-N-(p-hydroxybenzoyl)aminophenyl]-2,6-bis (trichloromethyl)-s-triazine | 2 |
| Victoria Pure Blue BOH (available from Hodogaya Chemical Co., Ltd.) | 3 |
| Megafac F-177 (a fluorine atom-containing surfactant available from Dainippon Ink and Chemicals, Inc.) | 0.6 |
| methyl ethyl ketone | 1500 |
| propylene glycol monomethyl ether | 1500 |

The PS plate thus prepared was cut into a large number of sheets having a size of 1,003 mm×800 mm and each sheet was imagewise exposed to light, for 60 seconds, from a 3 KW metal halide lamp at a distance of 1 m through an original film.

To a developing bath of a commercially available automatic developing machine PS-900D provided with a dip type developing bath (Fuji Photo Film Co., Ltd.), there was added a developer which was an aqueous solution of potassium silicate having a molar ratio, $[SiO_2]/[M_2O]$, of 1.2 and an $SiO_2$ content of 1.4% by weight containing 0.04% by weight of an amphoteric surfactant: N-alkyl-N,N-dihydroxyethyl betaine, followed by subjecting the imagewise exposed PS plate to a running treatment over one month in a rate of 100 sheets per day, while maintaining a predetermined activity level of the developer by detecting the reduction in the activity of the developer due to the processing of the PS plate and the absorption of carbon dioxide in air by a built-in conductance sensor of PS-900D and supplementing a replenisher having a molar ratio, $[SiO_2]/[M_2O]$, of 0.72 and an $SiO_2$ content of 1.80% by weight according to a feedback control system with a computer. The activity of the developer was checked in the same manner used in Example 19.

Tests for the presence of scratch marks on the light-sensitive layer during transportation, for the adhesion of ink on the back face of the PS plate through application of PI-2 ink, for the ability of the solid formed from the back coat-forming solution to be removed by an organic solvent and for the presence of scaly peeling off of the solid were performed in the same manner used in Example 19. The results thus obtained are listed in the following Table 7.

TABLE 7

| | PS plate of the present invention |
|---|---|
| Processing Properties | |
| Average Amount of Replenisher During Running | 40 cc/m$^2$ |
| Sensitivity Change During Running | ±0.5 step |
| Formation of Insolubles in Developing Bath | not observed |
| Quality | |
| Scratch Marks on Light-Sensitive Layer During Transportation | not observed |
| Adhesion of PI-2 Ink to Back Face of PS Plate | not observed |
| Production aptitude | |
| Ability of Solid Formed from Back Coat-Forming Solution to be Removed with Organic Solvent | good |
| Scaly Peeling Off of the Solid | not observed |

The amount of replenisher was reduced to about ½ times and like the result of Example 1, any insoluble matter was not formed and stable processing was ensured in the processing of the PS plate of the invention having a back coat layer.

Example 21

The surface (one side) of an aluminum plate having a thickness of 0.2 mm was grained with a nylon brush and an aqueous suspension of 400 mesh pumice stone and then sufficiently washed with water. After etching the plate by immersing in a 10% sodium hydroxide solution at 70° C. for 60 seconds and washing with running water, the grained surface of the plate was electrolytically surface-roughened in a 1% aqueous solution of nitric acid at an anodic voltage, $V_A$, of 12.7 V such that the quantity of electricity at the anode time was 160 coulomb/dm$^2$ using a sinusoidal alternating wave current. The plate was desmutted by immersing it in a 30% aqueous sulfuric acid solution at 55° C. for 2 minutes and anodized in a 20% aqueous solution of sulfuric acid at a current density of 2 A/dm$^2$ so that the thickness of the anodized layer formed on the electrolytically roughened surface was 2.7 g/m$^2$. At this stage, the anodized layer formed on the back face of the plate had a thickness of 0.2 to 0.5 g/m$^2$. The plate was then hydrophilized by immersing in a 2% aqueous solution of sodium silicate having a molar ratio, $[SiO_2]/[Na_2O]$, of 3.0 at 70° C.

Then a sol-gel reaction solution was applied onto the back face of the substrate thus treated in the same manner used in Example 20 to form a back coat layer.

Then the following light-sensitive solution was applied onto the surface of the substrate to give a light-sensitive layer in an amount of 1.7 g/m$^2$ (weighed after drying).

Light-sensitive Solution

| Component | Amount (parts by weight) |
|---|---|
| hexafluorophosphate of condensate of p-diazodiphenyl-amine with paraformaldehyde | 0.12 |
| 2-hydroxyethyl methacrylate copolymer (a product prepared by the method disclosed in Example 1 of U.S. Pat. No. 4,123,276) | 2.0 |
| Victoria Pure Blue BOH (available from Hodogaya Chemical Co., Ltd.) | 0.03 |
| Megafac F-177 (a fluorine atom-containing surfactant available from Dainippon Ink and Chemicals, Inc.) | 0.006 |
| 2-methoxyethanol | 15 |
| methanol | 10 |
| ethylene chloride | 5 |

The resulting negative-working PS plate showing good production aptitude was tested for the formation of scratch marks during bulk transportation in the same manner used in Example 13. As a result, any problem did not arise. Moreover, the production of the back coat layer did not suffer from any trouble.

Example 22

The same procedures used in Example 21 were repeated to give an aluminum plate having a grained surface and a back coat layer on the back face. The following light-sensitive solution was prepared and applied onto the grained surface of the aluminum substrate in an amount of 1.5 g/m$^2$ (weighed after drying) and dried to give a negative-working PS plate.

Light-Sensitive Solution

| Component | Amount (parts by weight) |
|---|---|
| methyl methacrylate/N-[6-(methacryloyloxy) hexyl]-2,3-dimethylmaleimide/methacrylic acid (molar ratio 10/60/30) copolymer (Mw = 3.5 × 10$^4$ (GPC); Tg = about 40° C. (DSC)) | 5 |
| 3-ethoxycarbonyl-7-methyl-thioxanthone | 0.30 |
| dodecylbenzenesulfonate of co-condensate of 4-diazo-diphenylamine, phenoxyacetic acid with formaldehyde | 0.20 |
| propylene glycol monomethyl ether | 50 |
| methyl ethyl ketone | 50 |
| Megafac F-177 (a fluorine atom-containing surfactant available from Dainippon Ink and Chemicals, Inc.) | 0.03 |
| Victoria Pure Blue BOH (available from Hodogaya Chemical Co., Ltd.) | 0.10 |

The negative-working PS plate thus prepared was subjected to contact exposure through a negative film. The exposure was performed by irradiating with light from a 2 KW very high pressure mercury lamp for 60 seconds. Then the imagewise exposed PS plate was developed at 25° C. for 30 seconds with an aqueous solution of potassium silicate having a molar ratio, $[SiO_2]/[K_2O]$, of 0.72, which was used as the replenisher in Example 20. After water-washing, a gumming solution was applied and the plate was fitted to a KORD printing press to perform printing. As a result, 50,000 copies free of any contamination on the non-image area were obtained.

Many identical negative-working PS plates were prepared and subjected to a bulk transportation test in the same manner used in Example 19 and the formation of scratch marks was not observed.

Example 23

The same procedures used in Example 19 were repeated to give a surface-grained and anodized substrate. The following sol-gel reaction solution diluted with the following dilution solution was applied onto the back face of the substrate with a bar coater and dried at 100° C. for one minute to give a back coat layer in an amount of 60 mg/m$^2$ (weighed after drying).

Sol-Gel Reaction Solution

| Component | Amount (parts by weight) |
|---|---|
| tetraethylsilicate | 50 |
| water | 86.4 |
| methanol | 10.8 |
| phosphoric acid (85%) | 0.08 |

The foregoing components were mixed and stirred and about 45 minutes thereafter, the mixture generated heat. After reacting them for 60 minutes with stirring, the following dilution solution was added to give a back coat-coating solution.

Dilution Solution

| Component | Amount (parts by weight) |
|---|---|
| phenol/formaldehyde resin (M.W. 3,000) | 3.5 |
| dibutyl phthalate | 5.0 |
| methanol | 800 |
| propylene glycol monomethyl ether | 270 |

Then a light-sensitive layer was formed on the surface of the substrate in the same manner used in Example 19 to give a positive-working PS plate.

The back coat layer of the PS plate thus formed had sufficient flexibility and never caused cracking. The plate was evaluated in the same manner used in Example 19 and was found to have quality identical to that of the PS plate of Example 19.

We claim:

1. A presensitized plate for use in making a lithographic printing plate comprising an aluminum substrate having anodized layers on both sides, a photosensitive layer on one side of the substrate and a coating layer of a metal oxide obtained by coating only the side of the substrate opposite to the side carrying the photosensitive layer with a sol-gel reaction solution obtained through hydrolysis and polycondensation of an organic or inorganic metal compound in water and an organic solvent in the presence of an acid or alkali catalyst in an amount ranging from 0.001% to 10% by weight on the basis of the weight of the starting metal compound and then drying the layer.

2. The presensitized plate of claim 1, wherein the organic metal compound is at least one member selected from the group consisting of metal alkoxides, metal acetylacetonates, metal acetates, metal oxalates and condensates obtained by partially hydrolyzing the foregoing metal compounds into the corresponding oligomers.

3. The presensitized plate of claim 1, wherein the organic metal compound is at least one member selected from silicon alkoxides and oligomers obtained by condensing the silicon alkoxides through partial hydrolysis.

4. The presensitized plate of claim 1, wherein the photosensitive layer is a positive-working or negative-working light-sensitive layer.

5. The presensitized plate of claim 1, wherein the thickness of the coating layer ranges from 0.01 to 1 g/m$^2$.

6. The presensitized plate of claim 1, wherein the presensitized plate comprises an organic underlying layer positioned between the aluminum substrate and the photosensitive layer.

7. The presensitized plate of claim 1, wherein the coating layer further comprises a colloidal silica.

8. The presensitized plate of claim 7, wherein an amount of the colloidal silica ranges from 30 to 200% by weight based on the weight of the metal compound.

9. The presensitized plate of claim 1, wherein the coating layer further comprises an organic polymer.

10. The presensitized plate of claim 9, wherein the organic polymer is a novolak resin.

11. The presensitized plate of claim 10, wherein the novolak resin is phenol novolak resin, cresol novolak resin or condensed resin of pyrogallol with acetone.

12. The presensitized plate of claim 9, wherein an amount of the organic polymer ranges from 5 to 50% by weight based on the weight of the metal compound.

13. The presensitized plate of claim 9, wherein the coating layer further comprises a plasticizer.

14. The presensitized plate of claim 13, wherein an amount of the plasticizer ranges from 5 to 30% by weight based on the weight of the metal compound.

15. The presensitized plate of claim 9, wherein the coating layer further comprises a fluorine-atom containing surfactant.

16. The presensitized plate of claim 15, wherein an amount of the surfactant ranges from 0.01 to 5% by weight based on the weight of the coating layer.

17. The presensitized plate of claim 1, wherein the coating layer has a thickness sufficient for inhibiting dissolution of the anodized layer from the substrate so that the presensitized plate provides a reduction in an amount of insolubles upon development compared to a comparable plate in the absence of said coating layer of a metal oxide.

* * * * *